US007033719B2

(12) United States Patent
Serizawa et al.

(10) Patent No.: US 7,033,719 B2
(45) Date of Patent: Apr. 25, 2006

(54) TONER HAVING SPECIFIC RELATION BETWEEN ABSORPTION SPECTRA, AND DEVELOPER, IMAGE FORMING METHOD AND IMAGE FORMING APPARATUS USING SAME

(75) Inventors: Manabu Serizawa, Minamiashigara (JP); Kazuhiko Yanagida, Minamiashigara (JP); Hidekazu Yaguchi, Minamiashigara (JP); Takahisa Fujii, Minamiashigara (JP); Emi Takahashi, Minamiashigara (JP); Yasuo Matsumura, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 156 days.

(21) Appl. No.: 10/627,801

(22) Filed: Jul. 28, 2003

(65) Prior Publication Data

US 2004/0152004 A1 Aug. 5, 2004

(30) Foreign Application Priority Data

Nov. 12, 2002 (JP) ..... 2002-328091

(51) Int. Cl.
*G03G 9/087* (2006.01)

(52) U.S. Cl. ..... 430/109.3; 430/111.4; 430/137.14; 430/124

(58) Field of Classification Search ..... 430/109.3, 430/111.4, 137.14, 124
See application file for complete search history.

(56) References Cited

U.S. PATENT DOCUMENTS 6,251,556 B1 * 6/2001 Yoshida et al. ..... 430/109.3
6,495,648 B1 * 12/2002 Inagaki et al. ..... 526/347

FOREIGN PATENT DOCUMENTS

| | | |
|---|---|---|
| JP | A 63-282752 | 11/1988 |
| JP | A 5-158282 | 6/1993 |
| JP | A 6-250439 | 9/1994 |
| JP | A 8-15909 | 1/1996 |
| JP | A 8-44111 | 2/1996 |
| JP | A 8-286416 | 11/1996 |
| JP | A 10-97098 | 4/1998 |
| JP | A 2000-250258 | 9/2000 |

* cited by examiner

*Primary Examiner*—John L Goodrow
(74) *Attorney, Agent, or Firm*—Oliff & Berridge, PLC

(57) ABSTRACT

The present invention provides a toner, comprising a binder resin and a colorant, and having a plurality of absorption peaks in a wave number range of 400 to 4,000 $cm^{-1}$ in an infrared absorption spectrum, wherein among the plurality of absorption peaks, a maximum absorption peak appears at wave number ranging from 500 to 800 $cm^{-1}$ and, given that the intensity of the maximum absorption peak is P1 and that the intensity of a second greatest absorption peak is P2, P1 and P2 satisfy the following equation (1), a developer comprising this toner, an image forming method using this toner, and an image forming apparatus using this toner.

$$1.6 \leqq P1/P2 \leqq 6.0 \quad \text{Equation (1)}$$

17 Claims, No Drawings

TONER HAVING SPECIFIC RELATION BETWEEN ABSORPTION SPECTRA, AND DEVELOPER, IMAGE FORMING METHOD AND IMAGE FORMING APPARATUS USING SAME

CROSS-REFERENCE TO RELATED APPLICATION

This application claims priority under 35 USC 119 from Japanese Patent Application No. 2002-328091, the disclosure of which is incorporated by reference herein.

BACKGROUND OF THE INVENTION

1. Field of the Invention

The present invention relates to a toner for developing electrostatic images, where the toner is well-suited for forming images with electrophotographic methods in a compact energy-efficient high-speed fixing device. The toner provides images with excellent smoothness, glossiness, and high resistance to offsetting. The present invention also related a developer, an image-forming method, and an image-forming device using said toner.

2. Description of the Related Art

Currently, methods for visualizing image data via electrostatic imaging, such as electrophotographic methods, are widely used in various fields. In electrophotography, an electrostatic latent image is formed on the surface of a photoreceptor via a charging step and an exposing step, and the electrostatic latent image is visualized via a developing step.

More specifically, in electrophotography, the latent image on the photoreceptor, which is formed via the charging and exposing steps, is developed with a toner in the developing step, and the resultant toner image is transferred to a recording material such as paper in a transferring step. It is then heated and melted with a fixing member at a high temperature in a fixing step, and is fixed on the surface of the recording material. It is known that, in the fixing step, unless both the toner and the recording material are heated to the minimum necessary temperature or higher by the fixing member, the toner is not fixed on the surface of the recording material.

When the recording material is insufficiently heated, only the portion of the toner which comes into contact with the fixing member is melted and adheres to the fixing member. This phenomenon is referred to as cold-offsetting. In addition, when the recording material is overheated, a hot offset phenomenon is caused, in which the viscosity of the toner is reduced, and a part or all of the toner on the recording material adheres to the fixing member. Therefore, it is necessary for the toner to have a fixing temperature range in which both cold offsetting and hot offsetting are not caused by heating with the fixing member.

In the fixing step, the real surface temperature of the fixing member becomes lower than the set temperature thereof. This is due to heat transfer from the fixing member heated at a high temperature to the recording material, and latent heat necessary for evaporation of a volatile material such as moisture contained in the recording material. Under ordinary circumstances, the real temperature is measured by a temperature sensor and, when the measured value becomes less than a predetermined value, the fixing member is heated again, and returned to the set temperature. However, for example, in the case of continuous fixation, since the amount of heat released from the surface of the fixing member is greater than the amount of heat supplied to the surface of the fixing member, the surface temperature of the fixing member is often lowered.

In recent years, image forming apparatuses are required to have flexibility, which broadens types of paper which can be used in the image forming apparatus. In this case, as described above, the real surface temperature of the fixing member becomes further lower than the set temperature thereof with increase in the weight of a paper sheet. For this reason, the difference between the set temperature and the real surface temperature of the fixing member tends to become greater.

In order to solve this problem, for example, increasing the amount of heat supplied to the surface of the fixing member, and use of a more sensitive temperature sensor disposed in the vicinity of the surface of the fixing member may be adopted. However, these solutions increase cost and cannot generally be adopted. Therefore, the real surface temperature of the fixing member at the time of fixation always varies relative to the set temperature.

On the other hand, in response to the demand for colorization in recent years, a color toner is required to have high developing properties, color mixing properties and high glossiness. It is difficult to separately control these properties and if these properties deteriorate, color reproductivity deteriorates, and the reliability of an image reduces. As described above, the real surface temperature of the fixing member always changes, and the real surface temperature of the fixing member tends to further lower with increase in the weight of a paper sheet and, therefore, there is a tendency that it becomes difficult to stably obtain fixed color images having constant quality, particularly, with regard to glossiness. Therefore, there is a demand for a color toner having wide flexibility for types of paper while maintaining high glossiness.

In order to obtain fixed images having high glossiness, a method of making a molecular weight distribution of a resin contained in the color toner narrow was proposed (see e.g. Japanese Patent Application Laid-Open (JP-A) Nos. 5-158282 and 8-015909). In particular, use of polyester as a toner resin is disclosed (see e.g. JP-A No. 10-097098), since the polyester resin generally can have a sharp melting property, namely a property in which a resin quickly melts when heated, by making the composition of polyester uniform, and obtain high glossiness at a lower fixing temperature.

Since the polyester resin has generally a short side chain of molecules constituting the resin, and the thermal motion of the side chain can be neglected, only the thermal motion of a main chain of the molecules corresponds substantially to the thermal motion of the resin and, therefore, the resin has a sharp melting property. However, when the toner has the sharp melting property and can be melted at a temperature that is too low, preservability of the toner deteriorates, and blocking is caused between toner particles, and such a toner is not preferable. Conversely, when the resin is molten only at a temperature that is too high, fixed images having high glossiness cannot be obtained, and such a toner is not preferable.

Further, control of a chargeability of the toner including the polyester resin tend to be difficult and, for example, the chargeability in summer is often quite different from that in winter. Considering this problem, use of a toner, to the surface of each particles of which fine particles of an inorganic oxide are adhered to reduce change in the chargeability with respect to environment, is disclosed and this method is effective initially. However, the fine particles of the inorganic oxide on the surface of the toner squeeze into the toner, or drop off from the toner surface during use in the form of a developer, and finally the resin properties affect toner characteristics even more. Therefore, it is still difficult to control the chargeability.

In recent years, an emulsification polymerization aggregating method for preparing toner particles having controlled shape and surface composition was proposed (see e.g. JP-A Nos. 63-282752 and 6-250439). In the emulsification polymerization aggregating method, a resin dispersion liquid is prepared by emulsification polymerization, a colorant dispersion liquid in which a colorant is dispersed in a solvent is separately prepared, these dispersion liquids are mixed with each often to form aggregated particles having a diameter corresponding to a toner particle diameter, and the resultant mixture is heated to coalesce the particles to obtain a toner particle. According to this emulsification polymerization aggregating method, it is possible to arbitrarily control a toner shape from an indefinite shape to a spherical shape by selecting heating temperature conditions.

Further, a so-called suspension polymerization method in which a polymerizable monomer, a colorant, a releasing agent and the like are dispersed and suspended in an aqueous medium, and the monomer is polymerized to prepare a toner was proposed. For example, a method for preparing a toner having a multi-layered structure in which a wax as a releasing agent is surrounded by a binder resin is disclosed in JP-A Nos. 8-044111 and 8-286416.

According to these methods, since the particle size distribution of the prepared toner particles can be narrowed, improving image quality is possible, and a toner including a binder resin with a low molecular weight and/or a high molecular weight, which was impossible to prepare by the conventional kneading grinding method, can be prepared.

Therefore, these suspension polymerization methods can easily prepare a toner having a sharp melting property. This is due to the fact that they can reduce the difference between a temperature at which thermal motion of the main chain of the binder resin contained in the toner occurs and a temperature at which thermal motion of side chains of the binder resin occurs. In contrast, in the conventional kneading grinding method, the binder resin contained in the resultant toner must have a molecular weight great enough to enable an additive such as a colorant to be stably dispersed therein. Therefore, thermal motion of the main chain of the binder resin occurs at a higher temperature, and the difference between a temperature at which thermal motion of the main chain occurs and a temperature at which thermal motion of side chains of the binder resin occurs is greater, and it is hard to obtain a toner having a sharp melting property In addition, a method of reducing uneven glossiness at the time of fixation to obtain a high quality image by defining a change rate of glossiness to temperature was proposed (see e.g., JP-A No. 2000-250258).

Although these methods can afford an excellent toner, it is necessary for toners to contain a component having a less molecular weight to an extent in order to actually impart sharp melting property to a toner. In order to decrease the molecular weight of a binder resin contained in a toner, it is necessary to increase the amount of polymerization initiator at the time of polymerization. In this case, controlling the molecular weight of the binder resin at the time of polymerization tends to be hard and, as a result, it is difficult to obtain the necessary sharp melting property.

In addition, in order to decrease the molecular weight of the binder resin, there exists a method in which a small amount of a surfactant acting as a dispersion stabilizer is added to an aqueous medium. However, when the surfactant is added, not only dose it tend to be difficult to control chargeability, but a washing step also tends to become complicated.

Therefore, there is an increasing demand for a toner having good balance between sharp melting property and chargeability at the time of fixation, and preservability.

Thus, there is a need for a highly glossy toner for developing electrostatic images, in particular full color toner prepared by an emulsification polymerization method or a suspension polymerization method, and a developer in which glossiness at the time of fixation is high, the difference in glossinesses of an image in a recording material (paper) and the difference between glossinesses of images formed on different recording materials are small, and a fixing temperature range at which the resultant toner image can be fixed is wide. In addition, there is a need for an image forming method and an image forming apparatus which can easily and simply form a full color image having high quality and high reliability.

SUMMARY OF THE INVENTION

A first aspect of the present invention is to provide a toner, comprising a binder resin and a colorant, and having a plurality of absorption peaks in a wave number range of 400 to 4,000 $cm^{-1}$ in an infrared absorption spectrum, wherein among the plurality of absorption peaks, a maximum absorption peak appears at wave number ranging from 500 to 800 $cm^{-1}$ and, given that the intensity of the maximum absorption peak is P1 and that the intensity of a second greatest absorption peak is P2, P1 and P2 satisfy the following equation (1).

$$1.6 \leqq P1/P2 \leqq 6.0 \qquad \text{Equation (1)}$$

In addition, a second aspect of the invention is to provide a two-component developer which comprises the above-mentioned toner and a carrier.

Further, a third aspect of the invention is to provide an image forming method, comprising the steps of: forming an electrostatic latent image on a surface of an electrostatic latent image holding member; developing the electrostatic latent image with a developer containing a toner on a surface of a developer holding member to form a toner image; transferring the toner image onto a surface of a recording material; and fixing the toner image onto the surface of the recording medium, wherein the toner is the toner of the first aspect.

In addition, a fourth aspect of the invention is to provide an image forming apparatus comprising an electrostatic latent image holding member, exposing means for exposing the electrostatic latent image holding member to form an electrostatic latent image, developing means for adhering the toner of the first aspect to the electrostatic latent image to form a toner image, transferring mean for transferring the toner image onto a surface of a recording medium, and fixing means for fixing the toner image onto the surface of the recording medium.

According to the invention, even when a toner prepared by polymerizing a vinyl monomer, which was previously difficult to implement, is used and is subjected to high speed fixing where a contact time of a fixing member and an unfixed image is relatively short, an image having high glossiness and high image quality can be provided by adding a specific amount of a specific compound at the time of polymerization.

Further, as the toner for developing electrostatic images, it is preferable to use colored toner particles obtained by mixing a resin particle dispersion liquid in which resin particles having an average particle diameter of 1 micron or less are dispersed and a colorant dispersion in which a colorant is dispersed, to form toner size aggregates including the resin particles and the colorant, and heating the resultant mixture to a temperature equal to or greater than a glass transition point of the resin to coalesce the toner size aggregates. It is preferable that the toner contains at least one kind releasing agent. In addition, the content of the releasing agent contained in the toner particles is preferably in the range of 0.5 to 15% by mass. It is preferable to use, as the binder resin of the toner, a resin containing at least one kind cross-linking component.

The electrostatic latent image developer preferably contains a carrier and the toner, and it is preferable that the carrier has a resin coating layer.

In addition, in the fixing step, it is preferable that the surface of a fixing member is made of a fluororesin.

DETAILED DESCRIPTION OF THE INVENTION

The present invention will be explained in detail below.

<Toner for Developing Electrostatic Images>

The toner of the invention is characterized in that it has a plurality of absorption peaks in an infrared absorption spectrum having a wave number region ranging from 400 to 4,000 $cm^{-1}$ and, among the plurality of absorption peaks, a maximum absorption peak appears in a wave number region ranging from 500 to 800 $cm^{-1}$ and, given that the intensity of the maximum absorption peak is P1 and that the intensity of a second greatest absorption peak is P2, P1 and P2 satisfy the following equation (1).

$$1.6 \leqq P1/P2 \leqq 6.0 \quad \text{Equation (1)}$$

That is, a polymerization reaction is conducted with a specific compound so that the resultant toner has controlled absorption intensity which appears in a specific wave number region of an infrared absorption spectrum, and contains, as a main component of a binder resin, the resulting resin having controlled molecular weight and molecular weight distribution, whereby, the resultant toner also has high glossiness at the time of fixation and has a wide fixing temperature region.

Generally, the glossiness of a toner for heating fixation depends from the thermal property of a binder resin. A powdery toner is used to turn an electrostatic latent image on the surface of a photoreceptor into a toner image in a developing step, and the toner image is transferred onto the surface of a recording material via a transferring step. Then, in a fixing step, the toner image on the surface of the recording material is heated by a fixing member together with the recording material, to melt-fix the toner image on the recording material. Depending on the toner characteristics and/or fixing conditions, the molten state of the toner at the time of fixation easily changes and, for this reason, the glossiness easily changes, too.

In order to obtain a fixed image having high glossiness while simultaneously decreasing a change in glossiness caused by fixing conditions of the toner image, it is preferable that a change in the thermal melting property of the toner at a fixing temperature is unresponsive to changes in temperature. In order to realize this, it is preferable that a molecular weight distribution of the binder resin of the toner is wide on both of a high molecular weight side and a low molecular weight side, and further preferably wider on the low molecular weight side.

For this reason, when a styrene-acrylic resin is used as the binder resin, it is preferable that a weight average molecular weight (Mw) of the resin is in the range of 20,000 to 40,000 and a number average molecular weight (Mn) of the resin is in the range of 3,000 to 8,000. Further, it is preferable that a molecular weight distribution (Mw/Mn) is in the range of 3.0 to 7.0, and more preferably in the range of 3.0 to 5.0.

The present inventors found that, in order to obtain the above-mentioned resin having a preferable molecular weight and a preferable molecular weight distribution, it suffices to control a kind and a blending amount of an additive at the time of polymerization of the binder resin used in a toner. This also applies to cases involving a toner obtained by suspension polymerization where a toner is prepared simultaneously with polymerization of the binder resin.

More specifically, we found that, examples of the additive used in polymerization include a dispersion stabilizer for stabilizing particle diameters of dispersion particles in an aqueous dispersion medium, a polymerization initiator for initiating polymerization, and a chain transfer agent for controlling a polymerization degree at the time of polymerization and, among them, in order to realize the invention, it is most suitable to control a polymerization degree of the binder resin at the time of polymerization by appropriately selecting a blending amount of the chain transfer agent.

It is known that, generally, the dispersion stabilizer and the polymerization initiator also affect a polymerization degree, and, for example, a surfactant, inorganic fine particles or a polymer dispersant is used as the dispersion stabilizer. However, when the surfactant or the polymer dispersant is used, it becomes difficult to control chargeability of the resultant resin. When the inorganic fine particles are used, the particles enter into the resin after polymerization and increases a viscosity of the resultant toner, and glossiness of the resultant toner tends to lower.

In addition, although organic peroxide or an inorganic peroxide is generally used as the polymerization initiator, the organic peroxide is generally expensive, and the residue tends to enter into the resultant toner resin, and change the characteristics of the prepared toner. When the inorganic peroxide is used, an inorganic salt generally exists at at least one end of the resin, the viscosity of the resin tends to increase, and glossiness lowers. When these additives are used for the essential purpose thereof, there is no problem. However, control of the polymerization degree of the resin by adjusting amounts of additives is not suitable for realizing the invention.

As described above, in the invention, high glossiness can be obtained by suitably selecting the amount of a chain transfer agent and then preparing a resin having a desired polymerization degree and a desired viscosity.

Generally, ingredients involved in polymerization are a polymerizable monomer, a polymerization initiator and a chain transfer agent. After a mixture of these materials is brought into a deoxygenated state, a polymerization growing point is generated from the polymerization initiator. The polymerization initiator having the polymerization growing point reacts with the polymerizable monomer, successively producing a chain reaction to a subsequent polymerizable monomer to form a resin molecule. The chain transfer agent once moves a polymerization growing point of the resin molecule into the chain transfer agent itself, and stops a chain reaction of the resin molecule. Further, the chain transfer agent having the polymerization growing point reacts with another polymerizable monomer to form a new resin molecule. In such a manner, a polymerization degree of the resin can be adjusted, and the chain transfer agent becomes a component of the resin and, thus, the agent is suitable for the invention.

As the chain transfer agent in the invention, an agent having a carbon-sulfur covalent bond is suitable. The carbon-sulfur covalent bond has usually absorption peak in a wave number region ranging from 500 to 800 $cm^{-1}$ in an infrared absorption spectrum. When a resin obtained by polymerization using a suitable amount of the chain transfer agent is used as the binder resin of the toner, absorption peak derived from the carbon-sulfur covalent bond becomes a maximum absorption peak of the toner in an infrared absorption spectrum having a wave number region of 400 to 4,000 $cm^{-1}$.

In the invention, given that the intensity of a maximum absorption peak in the infrared absorption spectrum is P1 and that the intensity of a second greatest absorption peak is P2, it is necessary that P1 and P2 satisfy the following equation (1).

$$1.6 \leqq P1/P2 \leqq 6.0 \qquad \text{Equation (1)}$$

By adjusting the amount of a chain transfer agent so that P1 and P2 satisfy the relationship of the above-described equation (1), a fixed image of the prepared toner has high glossiness, and the toner has a wide fixing temperature range and change in glossiness is small with respect to change in temperature.

The P1/P2 is preferably in the range of 1.6 to 4.0, and more preferably in the range of 1.6 to 2.5.

When the P1/P2 is less than 1.6, the effect of the chain transfer agent at the time of polymerization is small, and the glossiness of the resultant fixed image lowers. On the other hand, when the P1/P2 exceeds 6.0, since the effect of the chain transfer agent at the time of polymerization is too large, a molecular weight distribution of resin molecules becomes broad, cohesion between resin molecules at the time of fixation lowers, and offsetting is easily generated.

An infrared absorption spectrum of the toner can be measured by preparing a tablet-like measurement sample using a trace of a toner in accordance with a KBr method, and putting the measurement sample in a usual infrared absorption spectrometer.

Although the details why a toner having excellent glossiness can be obtained by controlling P1/P2 as described above is not clear, they are presumed as follows. When a chain transfer agent having a carbon-sulfur covalent bond is blended with other components so that the intensity of an absorption peak P1 in a wave number region ranging from 500 to 800 $cm^{-1}$ and an absorption peak P2 have a specific relationship, resin molecules at the time of polymerization reacts with the chain transfer agent at a constant ratio during their growing stage, and polymerization is stopped. Alternately, heat is generated with difficulty at the time of polymerization reaction, and a reaction rate becomes constant. Therefor, the molecular weight of the resultant resin easily becomes constant.

The chain transfer agent used in the invention is not particularly limited as far as it has an absorption peak in a wave number region of 500 to 800 $cm^{-1}$, and specifically, an agent having a covalent bond of a carbon atom and a sulfur atom is preferable, and more specifically, examples thereof include n-alkylmercaptans such as n-propylmercaptan, n-butylmercaptan, n-amylmercaptan, n-hexylmercaptan, n-heptylmercaptan, n-octylmercaptan, n-nonylmercaptan, and n-decylmercaptan; branched alkylmercaptans such as isopropylmercaptan, isobutylmercaptan, s-butylmercaptan, tert-butylmercaptan, cyclohexylmercaptan, tert-hexadecylmercaptan, tert-laurylmercaptan, tert-nonylmercaptan, tert-octylmercaptan, and tert-tetradecylmercaptan; aromatic ring-containing mercaptans such as allylmercaptan, 3-phenylpropylmercaptan, phenylmercaptan, and mercaptotriphenylmethane.

Among them, n-alkylmercaptans, branched alkylmercaptans and aromatic ring-containing mercaptans preferably have at least 4 carbon atoms, more preferably at least 6 carbon atoms, and still more preferably at least 8 carbon atoms. The reason for this is contemplated as follows. Since compatibility of mercaptans with other polymerizable monomers is improved by increasing the number of carbon atoms contained in the mercaptan, the polymerization reaction can be conducted stably.

In order to adjust the P1/P2 to the suitable range, it is necessary to control the amount of the chain transfer agent used in a polymerization reaction. Since the desired amount of the chain transfer agent varies depending on a kind of a polymerizable monomer in a reaction system, the reaction conditions and the like, the amount cannot be defined generally.

Specifically, for example, when a polymerizable monomer such as styrene, butyl acrylate and acrylic acid, a polymerization initiator described layer, such as potassium persulfate, a chain transfer agent such as n-dodecylmercaptan, and an emulsifying agent such as sodium dodecylsulfate are emulsification-polymerized at 75° C. in a solution containing water and 40% of solids while the internal air is being exhausted, a mass ratio of a mass A of the polymerization initiator and a mass B of the chain transfer agent, A/B, is preferably in the range of 0.6/4.0 to 0.04/10.0, and more preferably in the range of 1.0/3.5 to 0.1/8.0.

Resin component other than the chain transfer agent in the binder resin used in the invention can be used. Any components can be used as long as they have little or no absorption peak in a wave number region of 500 to 800 $cm^{-1}$, and as long as the compound having the carbon-sulfur covalent bond can be used as the chain transfer agent.

Examples of the resin component include homopolymers and copolymers of styrenes such as styrene, and α-methylstyrene (styrene type resin); homopolymers and copolymers of esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate (vinyl type resin); homopolymers and copolymers of vinylnitriles such as acrylonitrile, and methacrylonitrile (vinyl type resin); homopolymers and copolymers of vinyl ethers such as vinyl methyl ether, and vinyl isobutyl ether (vinyl type resin); homopolymers and copolymers of ketones such as vinyl methyl ketone, vinyl ethyl ketone, and vinyl isopropenyl ketone (vinyl type resin); and homopolymers and copolymers of olefins such as ethylene, propylene, butadiene, and isoprene (olefin type resin). These resins may be used alone or in combination of two or more.

Among them, from the viewpoint of control of Tg (glass transition temperature) of the toner, and control of a molecular weight of the resin, homopolymers and copolymers of styrenes, acrylic acid esters, methacrylic acid esters, butadiene and isoprene are preferably used, and copolymers of styrene-n-butyl acrylate, styrene-n-propyl acrylate, styrene-n-butyl methacrylate, styrene-n-propyl methacrylate, styrene-n-lauryl acrylate, styrene-n-lauryl methacrylate, methyl acrylate-n-butyl acrylate, and methyl methacrylate-n-butyl methacrylate are more preferably used.

In a step of polymerizing the polymerizable monomer to form resin molecules in the invention, a radical polymerization initiator (polymerization initiator) can be used.

Examples of the radical polymerization initiator include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-butylhydroperoxide pertriphenylacetate, tert-butyl performate, tert-butyl peracetate, tert-butyl perbenzoate, tert-butyl perphenylacetate, tert-butyl permethoxyacetate, and tert-butyl per-N-(3-toluyl)carbamate; azo compounds such as 2,2'-azobispropane, 2,2'-dichloro-2,2'-azobispropane, 1,1'-azo(methylethyl)diacetate, 2,2'-azobis(2-amidinopropane)hydrochloride, 2,2'-azobis(2-amidinopropane)nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1'-azobis-1,2-diphenylethane, poly(bisphenol A-4,4'-azobis-4-cyanopentanoate), and poly(tetraethylene glycol-2,2'-azobisisobutyrate); and 1,4-bis(pentaethylene)-2-tetrazene, and 1,4-dimethoxycarbonyl-1,4-diphenyl-2-tetrazene.

These polymerization initiators can be used in such a range that glossiness of a fixed image of the prepared toner is not lowered, and generally in a small amount. The amount of the initiator varies depending on a kind thereof, but is preferably around 3 parts by mass or less, more preferably 2 parts by mass or less, and still more preferably 1 part by mass or less relative to 100 parts by mass of the polymerizable monomer. These may be used alone, or a plurality of them may be used at the same time, if necessary.

When the toner of the invention is prepared by an emulsification polymerization aggregating method, the polymerization initiator is preferably water-soluble, and specifically, peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate and the like are preferable, and metal salts of peroxides of inorganic acids, such as ammonium persulfate, sodium persulfate, potassium persulfate and the like are more preterable in order to perform polymerization uniformly and stably.

In addition, when the toner of the invention is prepared by a suspension polymerization method, the polymerization initiator must be hydrophobic, and specifically, azo compounds such as 2,2'-azobispropane, 2,2'-dichloro-2,2'-azobispropane, 1,1'-azo(methylethyl)diacetate, 2,2'-azobis(2-amidinopropane)hydrochloride, 2,2'-azobis(2-amidinopropane)nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmthane, phenylazotriphenylmethane, 4-nitrophenylazotriphenylmethane, 1'-azobis-1,2-diphenylethane, poly(bisphenol A-4,4'-azobis-4-cyanopentanoate), poly(tetraethylene glycol-2,2'-azobisisobutyrate) and the like are preferable, and, valeronitriles such as 2,2'-azobis-2-methylvaleronitrile, dimethyl 4,4'-azobis-4-cyanovalerate, 2,2'-azobis-2,4-dimethylvaleronitrile and the like are more preferable from the viewpoint of a stability degree of a polymerization system at the time of polymerization of the toner.

At the time of polymerization of the binder resin in the invention, a cross-linking agent may be added to the reaction system, if necessary. When a cross-linking agent is added, glossiness of a fixed image is usually lowered. However, in the toner of the invention, by adding the cross-linking agent to such an extent that glossiness is hardly lowered, it becomes possible to impart uniformity to glossiness, and obtain a fixed image having high quality.

The reason for this is as follows. In usual radical polymerization, a reaction order of polymerizable monomers tends to be proportionate to respective amounts of the polymerizable monomers added and, at a stage of resin growth, the monomer tends to react with the same kind of polymerizable monomer to form a resin. Therefore, it is thought that a cross-linking agent usually present in a small amount in polymerizable monomers reacts at a final stage of polymerization. Usually, at the final stage of polymerization, the amount of the polymerizable monomer becomes small relative to a growing point of the resin, and resin molecules having a low molecular weight are easily produced. A cross-linking agent easily causes a cross-linking reaction with these molecules and, for this reason, it is presumed that the amount of the resin molecules having a low molecular weight is reduced, that the amount of resin molecules generating more glossiness than the necessary is decreased, and that uniformity of glossiness can be obtained.

Specific examples of the cross-linking agent include aromatic polyvinyl compounds such as divinylbenzene and divinylnaphthalene; polyvinyl esters of aromatic polyvalent carboxylic acid such as divinyl phthalate, divinyl isophthalate, divinyl terephthalate, divinyl homophthalate, divinyl/trivinyl trimesate, divinyl naphthalenedicarboxylate and divinyl biphenylcarboxylate; divinyl esters of nitrogen-containing aromatic compounds such as divinyl pyridinedicarboxylate; vinyl esters of unsaturated heterocyclic compound-carboxylic acid such as vinyl pyromchinate, vinyl furancarboxylate, vinyl pyrrole-2-carboxylate and vinyl thiophenecarboxylate; (meth)acrylic acid esters of straight polyhydric alcohols such as butanediol methacrylate, hexanediol acrylate, octanediol methacrylate, decanediol acrylate and dodecanediol methacrylate; (meth)acrylic acid esters of branched substituted polyhydric alcohols such as neopentyl glycol dimethacrylate and 2-hydroxy-1,3-diacryloxypropane; poly(meth)acrylic acid esters such as polyethylene glycol di(meth)acrylate and polypropylene polyethylene glycol di(meth)acrylate; and polyvinyl esters of polyvalent carboxylic acid such as divinyl succinate, divinyl fumarate, vinyl/divinyl maleate, divinyl diglycolate, vinyl/divinyl itaconate, divinyl acetonedicarboxylate, divinyl glutarate, divinyl 3,3'-thiodipropionate, divinyl/trivinyl transaconitate, divinyl adipate, divinyl pimelate, divinyl suberate, divinyl azelate, divinyl sebacate, divinyl dodecanedioate and divinyl brassylate.

In the invention, these cross-linking agents may be used alone, or in combination.

The amount of the cross-linking agent is not particularly limited as long as it has little influence on glossiness. The amount is preferably around 1% by mass or less, more preferably 0.6% by mass or less, and still more preferably 0.4% by mass or less relative to the total amount of the polymerizable monomer(s).

It is preferable that, as a colorant used in the toner of the invention, at least one selected from cyan, magenta and yellow pigments is used. The pigments may be used alone, or as a mixture of two or more of the same type pigments. Alternatively, a mixture of two or more of different type pigments may be used.

Examples of the colorant include various pigments such as chrome yellow, Hansa yellow, benzidine yellow, threne yellow, quinoline yellow, permanent orange GTR, pyrazolone orange, vulcan orange, Watchung red, permanent red, Brilliant carmine 3B, Brilliant carmine 6B, DuPont oil red, pyrazolone red, lithol red, rhodamine B lake, lake red C, rose Bengal, aniline blue, ultramarine blue, carco oil blue, methylene blue chloride, phthalocyanine blue, phthalocyanine green, and malachite green oxalate; and various dyes such as acridine dyes, xanthene dyes, azo dyes, benzoquinone dyes, azine dyes, anthraquinone dyes, dioxazine dyes, thiazine dyes, azomethine dyes, indigo dyes, thioindigo dyes, phthalocyanine dyes, aniline black, polymethine dyes, triphenylmethane dyes, diphenylmethane dyes, and thiazole dyes. A black pigment such as carbon black and the like, or a black dye may be mixed with these colorants to such an extent that the transparency is not lowered.

A method for preparing the toner of the invention is not particularly limited, but when a freedom degree of selection of usable materials, and a broadness of characteristic region of the prepared toner are taken into consideration, a wet process is more preferable than a kneading grinding method, and an emulsification polymerization aggregating method and a suspension polymerization method is more preferable.

The emulsification polymerization aggregating method includes the steps of mixing at least a resin particle dispersion liquid in which resin particles having an average particle diameter of 1 μm or less are dispersed and a colorant dispersion liquid in which a colorant is dispersed to form toner size aggregates including the resin particles and the colorant (aggregated particles) (hereinafter, the step is referred to as "aggregating step" in some cases), and heating the resultant mixture to a temperature equal to or greater than the glass transition point of the resin to coalesce the aggregated particles and form colored toner particles (hereinafter, the step is referred to as "coalescence step" in some cases).

In the aggregating step, components contained in the resin particle dispersion liquid, the colorant dispersion liquid and, optionally, a releasing agent dispersion liquid which are mixed with each other are aggregated to form aggregated particles. The aggregated particles are formed by heteroaggregation or the like, and include a compound having a monovalent or polyvalent charge such as an ionic surfactant, a metal salt and the like having different polarity from that of the aggregated particles for the purpose of stabilizing the aggregated particles and controlling a particle size/a particle size distribution of the aggregated particles.

In the coalescence step, the resin in the aggregated particles is fused at a temperature equal to or greater than the glass transition point of the resin.

Moreover, in the suspension polymerization method, colorant particles, releasing agent particles and a polymerizable monomer or monomers are suspended in an aqueous dispersion to which a dispersion stabilizer and the like may be added, and dispersed to a desired particle size and desired particle size distribution, and the polymerizable monomer or monomers are polymerized by means of heating or the like, and, the resultant polymer is separated from the aqueous medium, and may be washed and dried to form a toner.

In the invention, a surfactant can be used for the purpose of stabilization at the time of dispersing in the suspension polymerization method, the stability of emulsified particles at the time of emulsification polymerization in the emulsification polymerization aggregating method, and the dispersion stability of the resin particle dispersion liquid, the colorant dispersion liquid and the releasing agent dispersion liquid.

Examples of the surfactant include anionic surfactants such as sulfate salt, sulfonate salt, phosphate, and soap; cationic surfactants such as amine salt, and quaternary ammonium salt; and nonionic surfactants such as polyethylene glycol, alkylphenol ethylene oxide adduct, and polyhydric alcohol. Among them, ionic surfactants are preferable, and anionic surfactants and cationic surfactants are more preferable.

In the toner of the invention, generally, anionic surfactants have strong dispersing force, and are excellent in dispersing resin particles and a colorant and, as a surfactant for dispersing a releasing agent described later, the cationic surfactant is advantageous.

It is preferable that the nonionic surfactant is used with the anionic surfactant or cationic surfactant. Surfactants may be used alone, or in combination.

Specific examples of the anionic surfactant include fatty acid soaps such as potassium laurate, sodium oleate, and sodium castor oil; sulfate esters such as octyl sulfate, lauryl sulfate, lauryl ether sulfate, and nonyl phenyl ether sulfate; sulfonate salts such as sodium salt of alkylnaphthalenesulfonate including lauryl sulfonate, dodecylbenzene sulfonate, triisopropylnaphthalene sulfonate, and dibutylnaphthalene sulfonate, naphthalene sulfonate formalin condensate, monooctyl sulfosuccinate, dioctyl sulfosuccinate, lauric acid amide sulfonate, and oleic acid amide sulfonate; phosphate esters such as lauryl phosphate, isopropyl phosphate, and nonyl phenyl ether phosphate, dialkyl sulfosuccinate salts such as sodium dioctyl sulfosuccinate; and sulfosuccinate salts such as disodium lauryl sulfosuccinate.

Among the aforementioned anionic surfactants, fatty acid soaps such as potassium laurate, sodium oleate, and sodium castor oil; sulfate esters such as octyl sulfate, lauryl sulfate, lauryl ether sulfate, and nonyl phenyl ether sulfate; and sulfonate salts such as sodium salt of alkylnaphthalene sulfonate such as lauryl sulfonate, dodecylbenzene sulfonate, triisopropylnaphthalene sulfonate, and dibutylnaphthalene sulfonate, naphthalene sulfonate formalin condensate, monooctyl sulfosuccinate, dioctyl sulfosuccinate, lauric acid amide sulfonate, and oleic acid amide sulfonate are preferably used, and sulfonate esters such as octyl sulfonate, lauryl sulfate, lauryl ether sulfate, and nonyl phenyl ether sulfate; and sulfonate salts such as sodium salt of alkylnaphthalene sulfonate such as lauryl sulfonate, dodecylbenzene sulfonate, triisopropylnaphthalene sulfonate, and dibutylnaphthalene sulfonate, naphthalene sulfonate formalin condensate, monooctyl sulfosuccinate, dioctyl sulfosuccinate, lauric acid amide sulfonate, and oleic acid amide sulfonate are more preferably used because of excellent emulsifying property and dispersibility thereof.

Specific examples of the cationic surfactants include amine salts such as laurylamine hydrochloride, strearylamine hydrochloride, oleylamine acetate, stearylamine acetate, and stearylaminopropylamine acetate; and quaternary ammonium salts such as lauryltrimethylammonium chloride, dilauryldimethylammonium chloride, distearylammonium chloride, distearyldimetylammonium chloride, lauryldihydroxyethylmethylammonium chloride, oleylbispolyoxyethylenemethylammonium chloride, lauroylaminopropyldimethylethylammonium ethosulfate, lauroylaminopropyldimethylhydroxyethylammonium perchlorate, alkylbenzenedimethylammonium chloride, and alkyltrimethylammonium chloride.

Among the aforementioned cationic surfactants, amine salts such as laurylamine hydrochloride, stearylamine hydrochloride, oleylamine acetate, stearylamine acetate, and stearylaminopropylamine acetate are preferably used, and laurylamine hydrochloride and stearylamine hydrochloride are more preferably used because of excellent emulsifying property and dispersibility thereof.

Specific examples of the nonionic surfactants include alkyl ethers such as polyoxyethylene octyl ether, polyoxyethylene lauryl ether, polyoxyethylene stearyl ether, and polyoxyethylene oleyl ether; alkyl phenyl ethers such as polyoxyethylene octyl phenyl ether, and polyoxyethylene nonyl phenyl ether; alkyl esters such as polyoxyethylene laurate, polyoxyethylene stearate, and polyoxyethylene oleate; alkyl amines such as polyoxyethylene laurylamino ether, polyoxyethylene stearylamino ether, polyoxyethylene oleylamino ether, polyoxyethylene soybeanamino ether, and polyoxyethylene beef tallowamino ether; alkyl amides such as polyoxyethylene lauric acid amide, polyoxyethylene stearic acid amide, and polyoxyethylene oleic acid amide; vegetable oil ethers such as polyoxyethylene castor oil ether, and polyoxyethylene rapeseed oil ether; alkanol amides such as lauric acid diethanolamide, stearic acid diethanolamide, and oleic acid diethanolamide; and sorbitan ester ethers such as polyoxyethylene solbitan monolaurate, polyoxyethylene sorbitan monopalmitate, polyoxyethylene sorbitan monostearate, and polyoxyethylene sorbitan monooleate.

Among the aforementioned nonionic surfactants, alkyl ethers such as polyoxyethylene octyl ether, polyoxyethylene lauryl ether, polyoxyethylene stearyl ether, and polyoxyethylene oleyl ether; alkyl phenyl ethers such as polyoxyethylene octyl phenyl ether, and polyoxyethylene nonyl phenyl ethers; and alkyl esters such as polyoxyethylene laurate, polyoxyethylene stearate, and polyoxyethylene oleate are preferably used, and those in which the number of polyoxyethylene units is low, more specifically, those having 6 to 10 polyoxyethylene units are more preferably used from the viewpoint of their dispersibility, emulsifying property, and chargeability to a toner.

The content of the surfactant in each dispersion liquid may be such that the effect of the invention is not inhibited, and is generally small. Specifically, the content is in the range of around 0.01 to 3% by mass, more preferably in the range of 0.05 to 3% by mass, and still more preferably in the range of around 0.1 to 2% by mass. When the content is less than 0.01% by mass, the dispersed state of the dispersion liquid becomes unstable and, thus, particles contained in the dispersion liquid aggregate, and liberation of a particular compound occurs at the time of polymerization. On the other hand, when the content exceeds 3% by mass, it becomes difficult to control the molecular weight of the resultant resin particles, and a molecular weight distribution becomes broad. Generally, a dispersion of suspension-polymerized toner particles having a large particle diameter is stable even if the content of the surfactant contained in the dispersion is small.

When used in the suspension polymerization method in the invention, the aforementioned dispersion stabilizer can be an inorganic fine powder which it is hard for water to dissolve and is hydrophilic.

Examples of the inorganic fine powder include silica, alumina, titania, calcium carbonate, magnesium carbonate, tripotassium phosphate (hydroxyapatite), clay, diatomaceous earth, and bentonite. Among them, calcium carbonate, and tripotassium phosphate are preferable from the viewpoint of easiness of particle size formation of fine particles and easiness of removal.

In addition, a water-soluble polymer which is solid at a normal temperature may be used. Specifically, cellulose compounds such as carboxymethylcellulose, and hydroxypropylcellulose, polyvinyl alcohol, gelatin, starch, and gum arabic can be used.

When an emulsion aggregation combining method is used in preparing the toner of the invention, particles can be prepared by generating aggregation by a pH change in the aforementioned aggregating step. In order to obtain aggregation of particles stably and rapidly, or aggregated particles having a narrower particle size distribution, a flocculant may be used.

As the flocculant, a compound having a monovalent or polyvalent charge is preferable. Specific examples of such a compound include water-soluble surfactants such as the aforementioned ionic surfactants, and nonionic surfactants; acids such as hydrochloric acid, sulfuric acid, nitric acid, acetic acid, and oxalic acid; metal salts of inorganic acids such as magnesium chloride, sodium chloride, aluminium sulfate, calcium sulfate, ammonium sulfate, ammonium nitrate, silver nitrate, copper sulfate, and sodium carbonate; metal salts of aliphatic acid or aromatic acid such as sodium acetate, potassium formate, sodium oxalate, sodium phthalate, and potassium salicyate; metal salts of phenols such as sodium phenolate, metal salts of amino acid; and inorganic acid salts of aliphatic or aromatic amines such as triethanolamine hydrochloride, and aniline hydrochloride.

Among them, metal salts of inorganic acids such as magnesium chloride, sodium chloride, aluminium sulfate, potassium sulfate, ammonium sulfate, aluminium nitrate, silver nitrate, copper sulfate, and sodium carbonate; and inorganic or organic metal salts of aliphatic acids such as sodium acetate, potassium formate, sodium oxalate, sodium phthalate, and potassium salicylate are preferably used, and multivalent inorganic metal salts such as aluminium sulfate, aluminium nitrate, aluminium chloride, and magnesium chloride are more preferably used from the viewpoint of stability of aggregated particles, stability of the flocculant to the heat and time passing, removal at the time of washing and the like.

The amount of the flocculant to be added is different depending on the number of valency of the charge of the flocculant, and is small in any event. In the case of monovalency, the amount is around 3% by mass or less, in the case of divalency, the amount is around 1% by mass or less and, in the case of trivalency, the amount is around 0.5% by mass or less. Since a smaller amount of the flocculant is preferable, a compound whose valency is large is preferable.

The toner of the invention may contain a releasing agent. By including the releasing agent, the toner can be released from a fixing member without coating a silicone oil on the fixing equipment. Moreover, since an oil supplying equipment becomes unnecessary, it becomes possible to make the fixing equipment small and light.

When an emulsification aggregation combining method or a suspension polymerization method which is a process for preparing the toner of the invention is used, the releasing agent which is generally hydrophobic is incorporated into the interior of toner particles at the time of aggregation and combining in the emulsification polymerization aggregating method, or at the time of dispersing in the suspension polymerization method, and therefore, the releasing agent hardly resides on the surfaces of the particles. In addition, since it is presumed that a large amount of carboxyl groups having higher Tg are present on the particle surface, it is easy to form the particles. In the conventional kneading grinding method, since a large amount of releasing agent components are present on the particle surface at the time of grinding, particles easily and mutually fuse, which is not preferable.

Specific examples of the releasing agent include low-molecular weight polyolefins such as polyethylene, polypropylene, and polybutene; silicones having a softening point when by heated; aliphatic acid amides such as oleic acid amide, erucic acid amide, ricinolic acid amide, and stearic acid amide; vegetable waxes such as carnauba wax, rice wax, candelilla wax, Japan wax, and jojoba oil; animal waxes such as beewax; mineral/petroleum waxes such as montan wax, ozokerite, ceresin, paraffin wax, microcrystalline wax, and Fischer-Tropsch wax; ester waxes of higher fatty acid and higher alcohol such as stearyl stearate, and behenyl behenate; ester waxes of higher fatty acid and monohydric or polyhydric lower alcohol such as butyl stearate, propyl oleate, glyceride monostearate, glyceride distearate, and pentaerythritol tetrabehenate; ester waxes of higher fatty acid and polyhydric alcohol multimer such as diethylene glycol monostearate, dipropylene glycol distearate, diglyceride distearate, and triglyceride tetrastearate; sorbitan higher fatty acid ester waxes such as sorbitan monostearate; and cholesterol higher fatty acid ester waxes such as cholesteryl stearate.

In the invention, these releasing agents may be used alone or in combination.

The amount of the releasing agent to be added is preferably in the range of 0.5 to 50% by mass, more preferably in the range of 1 to 30% by mass, and still more preferably in the range of 5 to 15% by mass. When the addition amount is less than 0.5% by mass, the effect of addition of the releasing agent cannot be obtained. When the amount is more than 50% by mass, the influence of the releasing agent on chargeability of the toner tends to emerge, the toner is easily destructed in the interior of a developing equipment, the releasing agent adheres to carriers, and the chargeability of the toner easily lowers. Moreover, for example, when a color toner is used, exudation of the releasing agent onto the surface of a fixed image tends to be insufficient, the releasing agent tends to remain in the image, and the transparency of the image deteriorates.

Among the aforementioned releasing agents, low-molecular weight polyolefins such as polyethylene, polypropylene, and polybutene; vegetable waxes such as carnauba wax, rice wax, candelilla wax, Japan wax, and jojoba oil; animal waxes such as beewax; mineral/petroleum waxes such as montan wax, ozokerite, ceresin, paraffin wax, microcrystalline wax, and Fisher-Tropscth wax; and ester waxes of higher fatty acid and higher alcohol such as stearyl stearate, and behenyl behenate are preferably used, and low-molecular weight polyolefins such as polyethyrene, polypropyrene, and polybutene; vegetable waxes such as carnauba wax, rice wax, candelilla wax, Japan wax, and jojoba oil; and ester waxes of higher fatty acid and higher alcohol such as stearyl stearate, and behenyl behenate are more preferably used because they enter between a heating member of a fixing equipment and the surface of a toner image in a shorter period of time by heating the resultant toner, imparting the releasing effects.

In the invention, depending on the purpose, in addition to the aforementioned resin, colorant and releasing agent, other components (particles) such as an internal additive, a charge control agent, an inorganic powder, an organic powder, a lubricant or an abrasive may be contained in the toner.

The internal additive may be used in such an amount that the chargeability as one of the toner properties is not inhibited, and examples thereof include magnetic materials such as metals, alloys and compounds containing any of the metals, such as ferrite, magnetite, reduced iron, cobalt, manganese, or nickel.

The charge control agent is not particularly limited, but, in the case of a color toner, color or light color one can be preferably used. Examples thereof include quaternary ammonium salt compound, nigrosin compounds, dyes including a complex of aluminium, iron or chromium, and triphenylmethane pigments.

Examples of the inorganic powder include all particles which are usually used as an external additive for the surface of a toner, such as silica, titania, calcium carbonate, magnesium carbonate, tripotassium phosphate, or cesium oxide.

Examples of the organic powder include all particles which are usually used as an external additive for the surface of a toner, such as vinyl resins, polyester resin, or silicone resin. These inorganic powders and organic powders can be used as a flowability aid, cleaning aid or the like.

Examples of the lubricant include fatty acid amides such as ethylenebisstearic acid amide, and oleic acid amide, and metal salts of a fatty acid such as zinc stearate, or calcium stearate.

Examples of the abrasive include the aforementioned silica, alumina and cerium oxide.

The content of the colorant when the aforementioned resin, colorant and releasing agent are mixed with each other is 50% by mass or less, and preferably around 2 to 40% by mass.

In addition, the contents of the aforementioned other components may be such that the object of the invention is not inhibited, and is generally extremely small. Specifically, the content is in the range of around 0.01 to 5% by mass, and preferably in the range of around 0.5 to 2% by mass.

The dispersion medium in the aforementioned resin particle dispersion liquid, colorant dispersion liquid, releasing agent dispersion liquid and other components in the invention can be an aqueous medium.

Examples of the aqueous medium include water such as distilled water, and deionized water, and alcohols. These may be used alone or in combination.

In the invention, inorganic powders such as silica, alumina, titania, or calcium carbonate, or resin particles such as vinyl resin, polyester resin, or silicone resin may be added to the surface of the resulting toner for developing electrostatic images by applying a shearing force to them in the dry state of them. These inorganic powders and resin particles function as an external additive such as a flowability aid or a cleaning aid.

In the invention, glossiness of a fixed image can be controlled by the surface temperature of a fixing member. Toner particles of an unfixed image is molten by heat of the surface of the fixing member, and is fused on the surface of paper to form a fixed image. When the surface temperature of the fixing member is low, heat from the surface of the fixing member is mainly transferred to paper, and the toner is not sufficiently heated and cannot be molten. In this case, cold offsetting occurs in which toner particles adhere to the surface of the fixing member. As the surface temperature of the fixing member is risen, the temperature of paper is risen, toner particles are molten, molten toner is fixed on paper, and the toner is fixed. Since fusion of the toner and paper occurs preferentially as compared with fusion between toner particles, a phenomenon in which an image having low glossiness is fixed arises. As the surface temperature of the fixing member is risen, fusion between toner particles occur, and glossiness of the fixed image rapidly increases. When the surface temperature of the fixing member is more risen, toner particles are completely molten, and glossiness of the fixed image becomes saturated. When the surface temperature of the fixing member is still more risen, permeation of the toner into paper occurs, and then glossiness of the surface of the fixed image conversely decreases.

In the invention, as a result of attention to such a change of glossiness with respect to the surface temperature of the fixing member, the object of the invention can be more effectively attained by controlling the ratio of a temperature range at which glossiness of a fixed image rapidly increases and a temperature range at which glossiness becomes saturated.

That is, given that the surface temperature of a fixing member is t° C., that the range of around t−20° C. to t° C. is the temperature range at which glossiness rapidly increases, that the range of around t° C. to t+20° C. is the temperature range at which glossiness becomes saturated, that glossiness of a fixed image when the surface temperature of the fixing member is t−20° C. is G(t−20), that the glossiness of a fixed image when the surface temperature of the fixing member is t° C. is G(t), and that the glossiness of a fixed image when the surface temperature of the fixing member is t+20° C. is G(t+20), it is preferable for G(t−20), G(t) and G(t+20) to satisfy the following equation (2) in order to attain more effectively the object of the invention:

$$0 \leqq [G(t+20)-G(t)]/[G(t)-G(t-20)] \leqq 0.8 \qquad \text{Equation (2).}$$

In the invention, when [G(t+20)−G(t)]/[G(t)−G(t−20)] is a negative value, this indicates that the temperature of the fixing member exceeds the temperature range at which glossiness becomes saturated, and glossiness is not stable in each paper sheet and between sheets of paper, and not only does image quality deteriorate, but hot offsetting is also easily caused. In addition, when [G(t+20)−G(t)]/[G(t)−G(t−20)] exceeds 0.8, this indicates that the temperature of the fixing member has not reached the temperature range at which glossiness becomes saturated, and glossiness is not stable in each paper sheet and between sheets of paper, and image quality deteriorates.

Glossiness of the fixed image is obtained by preparing a solid fixed image (60 mm×60 mm) with each color toner, measuring glossiness of each solid fixed image with a photometer (GM-26D: manufactured by Murakami Coloring Material Technical Research Institute) at eight points of the image and obtaining the average of the measured values.

<Electrostatic Latent Image Developer>

The electrostatic latent image developer of the invention (hereinafter, simply referred to as "developer" in some cases) is not particularly limited insofar as it contains the aforementioned toner for developing electrostatic images of the invention, and may have an appropriate component composition depending on the purpose.

The aforementioned electrostatic latent image developer of the invention is prepared as a one-component electrostatic latent image developer when the toner for developing electrostatic latent images of the invention is used alone, or is prepared as a two-component electrostatic charge image developer when the toner is used together with a carrier.

The carrier is not particularly limited, but can be known ones. For example, resin-covered carriers described in JP-A Nos. 62-39879, and 56-11461 can be used.

Specific examples of the carrier include resin-covered carriers in which a resin coating layer is provided on the surface of each of nuclear particles.

Examples of the nuclear particles of the carrier include ordinary iron powder, ferrite and shaped magnetite, and it is preferable that the volume mean diameter of the nuclear particles is in the range of around 30 to 200 μm. From the viewpoint of high image quality, it is preferable to use ferrite as the nuclear particles.

Examples of the resin covering the nuclear particles include homopolymers of styrenes (such as styrene, parachlorostyrene, or α-methylstyrene), α-methylene fatty acid monocarboxylic acids (such as methyl acrylate, ethyl acrylate, n-propyl acrylate, lauryl acrylate, 2-ethylhexyl acrylate, methyl methacrylate, methacrylic acid, lauryl n-propylmethacrylate, or 2-ethylhexyl methacrylate), nitrogen-containing acryls (such as dimethylaminoethyl methacrylate), vinylnitriles (such as acrylonitrile, or methacrylonitrile), vinylpyridines (such as 2-vinylpyridine, or 4-vinylpyridine), vinyl ethers (such as vinyl methyl ether, or vinyl isobutyl ether), vinyl ketones (such as vinyl methyl ketone, vinyl ethyl ketone, or vinyl isopropenyl ketone), olefins (such as ethylene, or propylene), or fluorine-containing vinyl monomers (such as vinylidene fluoride, tetrafluoroethylene, or hexafluoroethylene), copolymers of two or more kinds of the above-described monomers, silicone resins obtained by polymerizing methylsilicone and/or methylphenylsilicone, polyesters containing bisphenol or glycol, epoxy resin, polyurethane resin, polyamide resin, cellulose resin, polyether resin, and polycarbonate resin. These resins may be used alone or in combination.

The covering amount of the covering resin is preferably in the range of around 0.1 to 10 parts by mass, and more preferably in the range of 0.5 to 3.0 parts by mass relative to 100 parts by mass of the nuclear particles.

Among the resin covering the nuclear particles, homopolymers of α-methylene fatty acid monocarboxylic acids (such as methyl acrylate, ethyl acrylate, n-propyl acrylate, lauryl acrylate, 2-ethylhexyl acrylate, methyl methacrylate, methacrylic acid, lauryl n-propylmethacrylate, or 2-ethylhexyl methacrylate), or fluorine-containing vinyl monomers (such as vinylidene fluoride, tetrafluoroethylene, or hexafluoroethylene), copolymers of two or more kinds of the above-described monomers, and silicone resins made of methylsilicone and/or methylphenylsilicone can be suitably used.

In preparing the carrier, a heating-type kneader, a heating-type Henschel mixer and a UM mixer can be used and, depending on the amount of the covering resin, a heating-type flowing and rotating bed, and a heating type kiln can be used.

The ratio of the toner for developing electrostatic images of the invention and the carrier in the electrostatic latent image developer is not particularly limited, but can be appropriately selected depending on the purpose.

In the method for preparing the toner for developing electrostatic images of the invention, a toner can be obtained by preparing a resin by emulsification polymerization, hetero-aggregating the resin together with a pigment dispersion liquid, a releasing agent dispersion liquid and the like to form aggregated particles, heating the aggregated particles at a temperature equal to or greater than a glass transition point of the resin, or by dispersing a pigment, a releasing agent and the like in a polymerizable monomer, and granulating them, followed by polymerization. For example, colored resin particles or resin particles containing the releasing agent therein, which are obtained by seed polymerization or the like using the coloring material or the releasing agent as nuclei, may be hetero-aggregated and coalesced.

The charged amount of the toner for developing electrostatic images is preferably in the range of 10 to 40 μC/g, and more preferably in the range of 15 to 35 μC/g, as an absolute value. When the charged amount is less than 10 μC/g, the background portion of the resultant image tends to stain. When the amount exceeds 40 μC/g, image density tends to lower.

The ratio of the charged amount of this toner for developing electrostatic images in summer (under high temperature and high humidity environment) and the charged amount thereof in winter (under low temperature and low humidity environment)(the charged amount in summer/the charged amount in winter) is preferably in the range of 0.5 to 1.5, and more preferably in the range of 0.7 to 1.3. When the ratio is outside the above-mentioned preferable range, the dependency of the toner on environment is high, and chargeability of the toner is unstable, which may not be practically preferable.

In addition, the surface area of the toner for developing electrostatic latent images of the invention is not particularly limited, but any surface area can be used as long as it is in a range that can be used in the ordinary toners. Specifically, when measured by BET method, the surface area is preferably in the range of 0.5 to 10 $m^2/g$, more preferably in the range of 1.0 to 7 $m^2/g$, and still more preferably in the range of 1.2 to 5 $m^2/g$.

<Image Forming Method>

An image forming method using the developer of the invention includes an electrostatic latent image forming step, a developing step, a transferring step and a fixing step. These steps are general steps, and are described in, for example, JP-A Nos. 56-40868, 49-91231. The image forming method of the invention can be carried out by a known image forming apparatus such as copying machine, or facsimile machine.

In the electrostatic latent image forming step, an electrostatic latent image is formed on the surface of an electrostatic latent image holding member. In the developing step, the electrostatic latent image is developed by a developer layer on the surface of a developer holding member to form a toner image. The developer layer is not particularly limited as long as it contains the electrostatic latent image developer of the invention containing the toner for developing electrostatic latent images of the invention. In the transferring step, the toner image is transferred onto the surface of a recording material. In the fixing step, the toner image transferred onto the surface of the recording material is fixed by heating with a fixing member.

In order to form a full color image, the image is obtained by laminating and transferring toner images which have been developed with cyan magenta and yellow toners and an optional black toner, respectively, in the developing step. At this time, it is preferable that the respective colored images are once laminated and transferred onto the surface of an intermediate transferring medium (primary transfer), and that the resultant full color image is transferred onto a recording material (secondary transfer), in order to obtain an image having no positional deviation and having excellent developing property.

In the fixing step, glossiness of the surface of the toner image (fixed image) fixed on the surface of a paper sheet (recording material) depends on the weight of the paper sheet, a contact time of the paper sheet and the fixing member at the time of fixation, and the surface temperature of the fixing member. In the image forming method of the invention, a color image having preferable glossiness can be obtained by using a paper sheet having weight of around 30 to 150 $g/m^2$ and setting the contact time of the paper sheet and the fixing member to 30 to 100 ms, and setting the surface temperature of the fixing member to 160 to 200° C.

In the invention, in order to respond to a so-called high speed process, it is preferable to adjust the weight of the paper sheet, the contact time of the paper sheet and the fixing member, the surface temperature of the fixing member/and the like so that glossiness G (180) when the surface temperature of the fixing member is 180° C. is 20% or larger. In addition, it is preferable that G (180) is 26% or larger.

In order to obtain the desired glossiness of a fixed image using the toner of the invention, the weight of the paper sheet, the contact time of the paper sheet and the fixing member, and the surface temperature of the fixing member may be outside the aforementioned range. For example, when weight of the paper sheet is less than 30 $g/m^2$, the contact time of the paper sheet and the fixing member exceeds 100 ms, and the surface temperature of the fixing member exceeds 200° C., it is anticipated that glossiness becomes high and that offsetting occurs. However, the desired glossiness can be obtained by setting at least one of these conditions to the aforementioned range.

Similarly, for example, when weight of the paper sheet exceeds 150 $g/m^2$, the contact time of the paper sheet and the fixing member is less than 30 ms, and the surface temperature of the fixing member is lower than 160° C., high glossiness cannot be obtained. However, the desired glossiness can be obtained by setting at least one of these conditions to the aforementioned range. However, in this case, flexibility of paper may be lost. Alternatively, it may become difficult to control the temperature of the fixing equipment, which results in a large and complicated fixing equipment.

In the image forming method of the invention, a heating roll (heating member) having a heating element in the interior of a hollow metal roll, or a heating roll which has a resistor having a high electric resistance in the vicinity of the surface of a substrate and which generates heat when electricity is applied thereto can be used as a fixing member. In addition, in order to contact the heating member and paper, a pressure roll (pressure member) can be usually provided so that paper can contact with the heating member. As the pressure member, a metal roll having a surface covered with a resin can be used. Alternatively, a heating element can be provided in the interior or on the surface of the pressure roll so that the pressure roll can produce heat. In this case, since decrease in the surface temperature of the heating member due to heat absorption by paper when the paper is passing the heating member can be further reduced, deterioration of image quality can be suppressed. Alternatively, a so-called belt fixation can be used in which a part of an endless belt in which both ends thereof are bonded to each other by adhesion, fusion or the like is brought into contact with the heating member while pressure is applied to the belt and the heating member. The belt fixation enables high speed/or low temperature fixation, since the area of a paper sheet contacting with the heating member can be increased.

In order to obtain uniformity of glossiness of a fixed image, the heating member can have a rubber and/or resin layer as a surface layer thereof. A rubber and/or resin having low adhesive property with respect to a molten toner is advantageous from the viewpoint of prevention of hot offsetting. Usually, as the rubber and/or resin having low adhesive property with respect to a molten toner, those having lower surface energy than that of the molten toner are preferable.

Specifically, homopolymers and copolymers of fluorine-containing polymerizable monomers such as ethylene fluoride, vinylidene fluoride, trifluoroethylene, tetrafluoroethylene, perfluorobutylethyl acrylate, or perfluorohexylethyl acrylate can be used as such. Alternatively, copolymers of the fluorine-containing polymerizable monomer and any of styrenes (such as styrene, parachlorostyrene, or α-methylstyrene), esters having a vinyl group (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, or 2-ethylhexyl methacrylate), vinylnitriles (such as acrylonitrile, or methacrylonitrile), vinyl ethers (such as vinyl methyl ether, or vinyl isobutyl ether), vinyl ketones (such as vinyl methyl ketone, vinyl ethyl ketone, or vinyl isopropenyl ketone), and olefins (such as ethylene, propylene, butadiene, or isoprene) may also be used.

Further, a mixture of a resin and/or a rubber containing no fluorine, and the above-mentioned fluorine-containing resin and/or rubber may also be used, or silicone resins made of methylsilicone, or phenylsilicone may also be used.

Type of paper used in the image forming method of the invention is not particularly limited, but, in order to obtain high quality image, it is preferable that an arithmetic average roughness Ra of the surface of a paper sheet, shown in JIS B 0601-94, is 1.0 μm or less. The surface of the paper sheet may not be treated, but, in order to obtain glossiness, resin-coated paper in which a resin such as polyester and the like is coated on the surface of the paper sheet is preferable.

The aforementioned arithmetic average roughness Ra of the paper surface can be easily measured by a method of JIS B 0651-76, JIS B 0652-73 or the like.

EXAMPLES

The present invention will be explained while the following Examples are referred, but the invention is not limited by these Examples at all.

In the following description, "part" means part by mass.

First, a toner and a developer used in the following Examples and Comparative Examples will be explained. In the following description, the average particle diameter of each toner is measured with a coulter counter (trade name: TA2 type, manufactured by Beckman Coulter, Inc.). The molecular weight and the molecular weight distribution of each resin of resin particles or toner particles are measured with gel permeation chromatography (trade name: HLC-8120GPC, manufactured by Tosoh Corporation). The weight average molecular weight Mw and number average molecular weight Mn shown bellow are obtained by using tetrahydrofuran as a solvent, and converting measured values using styrene. The glass transition point of the resin of the resin particles or toner particles is measured at a programming rate of 3° C./min. with a differential scanning calorimeter (trade name: DSC-50, manufactured by Simadzu Corporation).

Preparation of Various Dispersion Liquids

Preparation of Resin Particle Dispersion Liquid (1)

| | |
|---|---|
| Styrene | 72.8 parts |
| n-Butyl acrylate | 18.2 parts |
| Acrylic acid | 2.0 parts |
| Hexanediol acrylate | 0.4 part |
| tert-Dodecylmercaptan | 6.6 parts |

(all manufactured by Wako Pure Chemical Industries, Ltd.)

An oil phase obtained by mixing and dissolving the above components and an aqueous phase in which 1.5 parts of Newrex R (manufactured by Nippon Oil & Fats Co., Ltd.) has been dissolved in 150 parts of deionized water are mixed with each other and dispersed in a flask, and then agitated slowly for 10 minutes. A solution in which 0.3 part of potassium persulfate (manufactured by Wako Pure Chemical Industries, Ltd.) has been dissolved in 10 parts of deionized water is added to the resultant dispersion liquid. After sufficient nitrogen replacement, the flask is heated with an oil bath until the temperature of the content thereof reaches 70° C. while the content of the flask is stirred. The flask is maintained at 70° C. for 6 hours to conduct emulsification polymerization. Thereafter, this reaction solution is cooled to room temperature. Thus, a resin particle dispersion liquid (1) is obtained.

A part of this resin particle dispersion liquid (1) is allowed to stand in an oven at 80° C. to remove moisture, the properties of the resultant residue are measured, and Mw is found to be 30,100, Mw/Mn is found to be 4.26, and Tg is found to be 52° C.

Preparation of Resin Particle Dispersion Liquid (2)

| | |
|---|---|
| Styrene | 73.3 parts |
| n-Butyl acrylate | 17.2 parts |
| Acrylic acid | 1.2 parts |
| Hexanediol acrylate | 0.1 part |
| n-Dodecylmercaptan | 8.2 parts |

(all manufactured by Wako Pure Chemical Industries, Ltd.)

An oil phase obtained by mixing and dissolving the above components and an aqueous phase in which 1.5 parts of Newrex R (manufactured by Nippon Oil & Fats Co., Ltd.) has been dissolved in 150 parts of deionized water are mixed with each other and dispersed in a flask, and then agitated slowly for 10 minutes. A solution in which 0.12 part of potassium persulfate (manufactured by Wako Pure Chemical Industries, Ltd.) has been dissolved in 10 parts of deionized water is added to the resultant dispersion liquid. After sufficient nitrogen replacement, the flask is heated with an oil bath until the temperature of the content thereof reaches 70° C. while the content of the flask is stirred. The flask is maintained at 70° C. for 6 hours to conduct emulsification polymerization. Thereafter, this reaction solution is cooled to room temperature. Thus, a resin particle dispersion liquid (2) is obtained.

A part of this resin particle dispersion liquid (2) is allowed to stand in an oven at 80° C. to remove moisture, the properties of the resultant residue are measured, and Mw is found to be 26,200, Mw/Mn is found to be 4.37, and Tg is found to be 51° C.

Preparation of Resin Particle Dispersion Liquid (3)

| | |
|---|---|
| Styrene | 74.5 parts |
| n-Butyl acrylate | 16.3 parts |
| Acrylic acid | 1.5 parts |
| Hexanediol acrylate | 0.2 part |
| n-Decylmercaptan | 7.5 parts |

(all manufactured by Wako Pure Chemical Industries, Ltd.)

An oil phase obtained by mixing and dissolving the above components and an aqueous phase in which 1.5 parts of Newrex R (manufactured by Nippon Oil & Fats Co., Ltd.) has been dissolved in 150 parts of deionized water are mixed with each other and dispersed in a flask, and then agitated slowly for 10 minutes. A solution in which 0.15 part of potassium persulfate (manufactured by Wako Pure Chemical Industries, Ltd.) has been dissolved in 10 parts of deionized water is added to the resultant dispersion liquid. After sufficient nitrogen replacement, the flask is heated with an oil bath until the temperature of the content thereof reaches 70° C. while the content of the flask is stirred. The flask is maintained at 70° C. for 6 hours to conduct emulsification polymerization. Thereafter, this reaction solution is cooled to room temperature. Thus, a resin particle dispersion liquid (3) is obtained.

A part of this resin particle dispersion liquid (3) is allowed to stand in an oven at 80° C. to remove moisture, the properties of the resultant residue are measured, and Mw is found to be 35,500, Mw/Mn is found to be 6.70, and Tg is found to be 54° C.

Preparation of Resin Particle Dispersion Liquid (4)

| | |
|---|---|
| Styrene | 82.66 parts |
| n-Butyl acrylate | 9.2 parts |
| Acrylic acid | 1.3 parts |
| Hexanediol acrylate | 0.4 part |
| 3-Phenylpropylmercaptan | 6.5 parts |

(all manufactured by Wako Pure Chemical Industries, Ltd.)

An oil phase obtained by mixing and dissolving the above components and an aqueous phase in which 1.5 parts of Newrex R (manufactured by Nippon Oil & Fats Co., Ltd.) has been dissolved in 150 parts of deionized water are mixed with each other and dispersed in a flask, and then agitated slowly for 10 minutes. A solution in which 0.15 part of potassium persulfate (manufactured by Wako Pure Chemical Industries, Ltd.) has been dissolved in 10 parts of deionized water is added to the resultant dispersion liquid. After sufficient nitrogen replacement, the flask is heated with an oil bath until the temperature of the content thereof reaches 70° C. while the content of the flask is stirred. The flask is maintained at 70° C. for 6 hours to conduct emulsification polymerization. Thereafter, this reaction solution is cooled to room temperature. Thus, a resin particle dispersion liquid (4) is obtained.

A part of this resin particle dispersion liquid (4) is allowed to stand in an oven at 80° C. to remove moisture, the properties of the resultant residue are measured, and Mw is found to be 31,700, Mw/Mn is found to be 5.11, and Tg is found to be 57° C.

Preparation of Resin Particle Dispersion Liquid (5)

| | |
|---|---|
| Styrene | 78.3 parts |
| n-Butyl acrylate | 12.7 parts |
| Acrylic acid | 1.8 parts |
| Divinyl adipate | 0.3 part |
| tert-Dodecylmercaptan | 6.9 parts |

(all manufactured by Wako Pure Chemical Industries, Ltd.)

An oil phase obtained by mixing and dissolving the above components and an aqueous phase in which 1.5 parts of Newrex R (manufactured by Nippon Oil & Fats Co., Ltd.) has been dissolved in 150 parts of deionized water are mixed with each other and dispersed in a flask, and then agitated slowly for 10 minutes. A solution in which 0.36 part of potassium persulfate (manufactured by Wako Pure Chemical Industries, Ltd.) has been dissolved in 10 parts of deionized water is added to the resultant dispersion liquid. After sufficient nitrogen replacement, the flask is heated with an oil bath until the temperature of the content thereof reaches 70° C. while the content of the flask is stirred. The flask is maintained at 70° C. for 6 hours to conduct emulsification polymerization. Thereafter, this reaction solution is cooled to room temperature. Thus, a resin particle dispersion liquid (5) is obtained.

A part of this resin particle dispersion liquid (5) is allowed to stand in an oven at 80° C. to remove moisture, the properties of the resultant residue are measured, and Mw is found to be 29,400, Mw/Mn is found to be 5.35, and Tg is found to be 55° C.

Preparation of Resin Particle Dispersion Liquid (6)

| | |
|---|---|
| Styrene | 72.5 parts |
| n-Butyl acrylate | 8.1 parts |
| Acrylic acid | 2.0 parts |
| Hexanediol acrylate | 0.4 part |
| tert-Dodecylmercaptan | 17.0 parts |

(all manufactured by Wako Pure Chemical Industries, Ltd.)

An oil phase obtained by mixing and dissolving the above components and an aqueous phase in which 1.5 parts of Newrex R (manufactured by Nippon Oil & Fats Co., Ltd.) has been dissolved in 150 parts of deionized water are mixed with each other and dispersed in a flask, and then agitated slowly for 10 minutes. A solution in which 0.09 part of potassium persulfate (manufactured by Wako Pure Chemical Industries, Ltd.) has been dissolved in 10 parts of deionized water is added to the resultant dispersion liquid. After sufficient nitrogen replacement, the flask is heated with an oil bath until the temperature of the content thereof reaches 70° C. while the content of the flask is stirred. The flask is maintained at 70° C. for 6 hours to conduct emulsification polymerization. Thereafter, this reaction solution is cooled to room temperature. Thus, a resin particle dispersion liquid (6) is obtained.

A part of this resin particle dispersion liquid (6) is allowed to stand in an oven at 80° C. to remove moisture, the properties of the resultant residue are measured, and Mw is found to be 17,200, Mw/Mn is found to be 8.19, and Tg is found to be 48° C.

Preparation of Resin Particle Dispersion Liquid (7)

| | |
|---|---|
| Styrene | 77.4 parts |
| n-Butyl acrylate | 18.1 parts |
| Acrylic acid | 3.0 parts |
| Hexanediol acrylate | 0.5 part |
| tert-Dodecylmercaptan | 1.0 part |

(all manufactured by Wako Pure Chemical Industries, Ltd.)

An oil phase obtained by mixing and dissolving the above components and an aqueous phase in which 1.5 parts of Newrex R (manufactured by Nippon Oil & Fats Co., Ltd.) has been dissolved in 150 parts of deionized water are mixed with each other and dispersed in a flask, and then agitated slowly for 10 minutes. A solution in which 6.2 parts of potassium persulfate (manufactured by Wako Pure Chemical Industries, Ltd.) has been dissolved in 10 parts of deionized water is added to the resultant dispersion liquid. After sufficient nitrogen replacement, the flask is heated with an oil bath until the temperature of the content thereof reaches 70° C. while the content of the flask is stirred. The flask is maintained at 70° C. for 6 hours to conduct emulsification polymerization. Thereafter, this reaction solution is cooled to room temperature. Thus, a resin particle dispersion liquid (7) is obtained.

A part of this resin particle dispersion liquid (7) is allowed to stand in an oven at 80° C. to remove moisture, the properties of the resultant residue are measured, and Mw is found to be 34,200, Mw/Mn is found to be 4.38, and Tg is found to be 54° C.

Preparation of Colorant Dispersion Liquid (1)

| | |
|---|---|
| Phthalocyanine pigment (trade name: PV FAST BLUE, manufactured by Dainichseika Color & Chemicals Mfg. Co., Ltd.) | 100 parts |
| Anionic surfactant (trade name: Neogen RK, manufactured by Dai-ichi Kogyo Seiyaku Co., Ltd.) | 2.0 parts |
| Deionized water | 250 parts |

The above-mentioned components are mixed and dissolved, and then dispersed with a homogenizer (trade name: Ultratarax, manufactured by IKA) to prepare a colorant dispersion liquid (1) in which a colorant (phthalocyanine pigment) is dispersed.

Preparation of Colorant Dispersion Liquid (2)

| | |
|---|---|
| Magenta pigment (trade name: PR122, manufactured by Dainichseika Color & Chemicals Mfg. Co., Ltd.) | 80 parts |
| Anionic surfactant (trade name: Neogen RK, manufactured by Dai-ichi Kogyo Seiyaku Co., Ltd.) | 1.5 parts |
| Deionized water | 200 parts |

The above-mentioned components are mixed and dissolved, and then dispersed with a homogenizer (trade name: Ultratarax, manufactured by IKA) to prepare a colorant dispersion liquid (2) in which a colorant (magenta pigment) is dispersed.

Preparation of Colorant Dispersion Liquid (3)

| | |
|---|---|
| Yellow pigment (trade name: PY180, manufactured by Clariant Japan) | 60 parts |
| Anionic surfactant (trade name: Neogen RK, manufactured by Dai-ichi Kogyo Seiyaku Co., Ltd.) | 2.0 parts |
| Deionized water | 250 parts |

The above-mentioned components are mixed and dissolved, and then dispersed with a homogenizer (trade name: Ultratarax, manufactured by IKA) to prepare a colorant dispersion liquid (3) in which a colorant (yellow pigment) is dispersed.

Preparation of Colorant Dispersion Liquid (4)

| | |
|---|---|
| Carbon black (trade name: Regal 330, manufactured by Cobot) | 50 parts |
| Anionic surfactant (trade name: Neogen RK, manufactured by Dai-ichi Kogyo Seiyaku Co., Ltd.) | 1.0 part |
| Deionized water | 150 parts |

The above-mentioned components are mixed and dissolved, and then dispersed with a homogenizer (trade name: Ultratarax, manufactured by IKA) to prepare a colorant dispersion liquid (4) in which a colorant (carbon black) is dispersed.

Preparation of Releasing Agent Dispersion Liquid (1)

| | |
|---|---|
| Polyethyrene wax (trade name: Polywax 725, manufactured by Toyo-Petrolite) | 80 parts |
| Anionic surfactant (trade name: Neogen RK, manufactured by Dai-ichi Kogyo Seiyaku Co., Ltd.) | 1.0 part |
| Deionized water | 120 parts |

The above-mentioned components are dissolved at 95° C., and then dispersed with a homogenizer (trade name: Ultratarax, manufactured by IKA) to prepare a releasing agent dispersion liquid (1) in which polyethylene wax is dispersed.

Preparation of Releasing Agent Dispersion Liquid (2)

| | |
|---|---|
| Stearyl stearate (manufactured by Nippon Oil & Fats Co., Ltd.) | 80 parts |
| Anionic surfactant (trade name: Neogen RK, manufactured by Dai-ichi Kogyo Seiyaku Co., Ltd.) | 1.0 part |
| Deionized water | 120 parts |

The above-mentioned components are dissolved at 85° C., and then dispersed with a homogenizer (trade name: Ultratarax, manufactured by IKA) to prepare a releasing agent dispersion liquid (2) in which polyethylene wax is dispersed.

Preparation of Toner for Developing Electrostatic Latent Images (1)

[Aggregating Step]

Preparation of Aggregated Particle

| | |
|---|---|
| Resin particle dispersion liquid (1) | 238.0 parts |
| Colorant dispersion liquid (1) | 17.5 parts |
| Releasing agent particle dispersion liquid (1) | 17.5 parts |
| Water glass (trade name: Snowtexs OS, manufactured by Nissan Chemical Industries, Ltd.) | 35.0 parts |
| Deionized water | 632.5 parts |
| Aluminium sulfate (manufactured by Wako Pure Chemical Industries, Ltd.) | 1.3 parts |

The above-mentioned components are placed into a round-type stainless flask, and dispersed with a homogenizer (trade name: Ultratarax T50, manufactured by IKA). The pH of the content in the flask is adjusted to 3.3, and the content is heated to 48° C. in a heating oil bath while stirred. The content is maintained at 48° C. for 25 minutes, the state of the resultant reaction system is observed with a light microscope, and it is confirmed that aggregated particles having an average particle diameter of about 5.0 μm are formed. 59.5 parts of the resin particle dispersion liquid (1) is slowly added to the resultant aggregated particle dispersion liquid, and the resultant mixture is heated and stirred at 48° C. for 25 minutes while the pH thereof is maintained at 3.3. Thereafter, the state of the resultant reaction system is observed with the light microscope, and it is confirmed that aggregated particles having an average particle diameter of about 5.5 μm are formed.

[Coalescence Step]

The pH of this aggregated particle dispersion liquid is 3.2. A 0.5 mass % aqueous solution of sodium hydroxide (manufactured by Wako Pure Chemical Industries, Ltd.) is slowly added to the aggregated particle dispersion liquid, and the pH of the mixture is adjusted to 6.8. Thereafter, the mixture is heated to 96° C. and maintained at 96° C. for 5 hours while stirred. Then, the pH of the resultant reaction system is adjusted to about 7, and the reaction product is filtered out, washed with 500 parts of deionized water four times, and dried with a vacuum dryer to obtain toner particles (1).

The resulting toner has a volume mean diameter of 5.8 μm, Mw of 29,600, and Mw/Mn of 4.31.

Two parts of colloidal silica (trade name: R972, manufactured by Japan Aerosil) is externally added to and mixed with 100 parts of the resulting toner particles (1), using a Henschel mixer to obtain a toner for developing electrostatic latent images (1).

An infrared absorption spectrum of this toner is measured and, as a result, a maximum absorption peak appears at 675 $cm^{-1}$, and the absorption intensity P1 thereof is 1.22. In addition, a second greatest absorption peak appears at 1740 $cm^{-1}$, and the absorption intensity P2 thereof is 0.71. Thereby, P1/P2 is 1.72.

Measurement of the infrared absorption spectrum is performed by the following method. First, trace of toner particles and potassium bromide are mixed with each other in a mortar and then the resultant mixture is pressurized into a tablet. The tablet is set in a cell for an infrared absorption spectrophotometer (trade name: FT/IR-410, manufactured by JASCO Corporation), and an absorption spectrum thereof is measured in a wave number range of 400 to 4,000 $cm^{-1}$.

Preparation of Electrostatic Latent Image Developer (1)

100 parts of ferrite particles (manufactured by Powdertech Co., Ltd., volume mean diameter: 50 μm), 2.6 parts of a styrene-methyl methacrylate copolymer resin (trade name: BR-52, manufactured by Mitsubishi Rayon, weight molecular weight: 85,000) and 400 parts of toluene are placed in a pressure type kneader, stirred and mixed at a normal temperature for 15 minutes. Thereafter, the temperature of the kneader is risen to 70° C. while the content is being stirred under reduced pressure to remove toluene. Then the residue is cooled, and obtained particles are classified with a sieve having a pore size of 105 μm to prepare a ferrite carrier (resin-covered carrier).

This ferrite carrier and the toner for developing electrostatic images (1) are mixed with each other to prepare a two-component electrostatic charge image developer (1) having a toner concentration of 7% by mass.

Preparation of Toner for Developing Electrostatic Images (2)

[Aggregating Step]

Preparation of Aggregated Particle

| | |
|---|---|
| Resin particle dispersion liquid (1) | 234.5 parts |
| Colorant dispersion liquid (2) | 21.0 parts |
| Releasing agent particle dispersion liquid (1) | 17.5 parts |
| Water glass (trade name: Snowtex Os, manufactured by Nissan Chemical Industries, Ltd.) | 35.0 parts |
| Deionized water | 632.5 parts |
| Aluminium sulfate (manufactured by Wako Pure Chemical Industries, Ltd.) | 1.5 parts |

The above-mentioned components are placed into a round-type stainless flask, and dispersed with a homogenizer (trade name: Ultratarax T50, manufactured by IKA). The pH of the content in the flask is adjusted to 3.3, and the content is heated to 48° C. in a heating oil bath while stirred. The content is maintained at 48° C. for 30 minutes, the state of the resultant reaction system is observed with a light microscope, and it is confirmed that aggregated particles having an average particle diameter of about 5.2 μm are formed. 59.9 parts of the resin particle dispersion liquid (1) is slowly added to the resultant aggregated particle dispersion liquid, and the resultant mixture is heated and stirred at 48° C. for 25 minutes while the pH thereof is maintained at 3.3. Thereafter, the state of the resultant reaction system is observed with the light microscope, and it is confirmed that aggregated particles having an average particle diameter of about 5.7 μm are formed.

[Coalescence Step]

The pH of this aggregated particle dispersion liquid is 3.3. A 0.5 mass % aqueous solution of sodium hydroxide (manufactured by Wako Pure Chemical Industries, Ltd.) is slowly added to the aggregated particle dispersion liquid, and the pH of the mixture is adjusted to 7.1. Thereafter, the mixture is heated to 96° C. and maintained at 96° C. for 5 hours while stirred. Then, the pH of the resultant reaction system is adjusted to about 7, and the reaction product is filtered out, washed with 500 parts of deionized water four times, and dried with a vacuum dryer to obtain toner particles (2).

The resulting toner particles (2) have a volume mean diameter of 5.9 μm, Mw of 29,500, and Mw/Mn of 4.30. Two parts of colloidal silica (trade name: R972, manufactured by Japan Aerosil) is externally added to and mixed with 100 parts of the resulting toner particles (2), using a Henschel mixer to obtain a toner for developing electrostatic latent images (2).

An infrared absorption spectrum of this toner is measured and, as a result, a maximum absorption peak appears at 674 $cm^{-1}$, and the absorption intensity P1 thereof is 1.25. In addition, a second greatest absorption peak appears at 1741 $cm^{-1}$, and the absorption intensity P2 thereof is 0.70. Thereby, P1/P2 is 1.79.

Preparation of Electrostatic Latent Image Developing Agent (2)

A two-component electrostatic latent image developer (2) having a toner concentration of 7% by mass is prepared in the same manner as in preparation of the two-component electrostatic latent image developer (1) except that the toner for developing electrostatic latent images (2) is used in place of the toner for developing electrostatic latent images (1) in preparation of the electrostatic latent image developing agent (1).

Preparation of Toner for Developing Electrostatic Images (3)

[Aggregating Step]

Preparation of Aggregated Particle

| | |
|---|---|
| Resin particle dispersion liquid (1) | 238.00 parts |
| Colorant dispersion liquid (3) | 29.2 parts |
| Releasing agent particle dispersion liquid (1) | 17.5 parts |
| Water glass (trade name: Snowtex OS, manufactured by Nissan Chemical Industries, Ltd.) | 35.0 parts |
| Deionized water | 620.8 parts |
| Aluminium sulfate (manufactured by Wako Pure Chemical Industries, Ltd.) | 1.3 parts |

The above-mentioned components are placed into a round-type stainless flask, and dispersed with a homogenizer (trade name: Ultratarax T50, manufactured by IKA). The pH of the content in the flask is adjusted to 3.2, and the content is heated to 48° C. in a heating oil bath while stirred. The content is maintained at 48° C. for 30 minutes, the state of the resultant reaction system is observed with a light microscope, and it is confirmed that aggregated particles having an average particle diameter of about 5.1 μm are formed. 59.5 parts of the resin particle dispersion liquid (1) is slowly added to the resultant aggregated particle dispersion liquid, and the resultant mixture is heated and stirred at 48° C. for 35 minutes while the pH thereof is maintained at 3.2. Thereafter, the state of the resultant reaction system is observed with the light microscope, and it is confirmed that aggregated particles having an average particle diameter of about 5.6 μm are formed.

[Coalescence Step]

The pH of this aggregated particle dispersion liquid is 3.2. A 0.5 mass % aqueous solution of sodium hydroxide (manufactured by Wako Pure Chemical Industries, Ltd.) is slowly added to the aggregated particle dispersion liquid, and the pH of the mixture is adjusted to 7.0. Thereafter, the mixture is heated to 96° C. and maintained at 96° C. for 5 hours while stirred. Then, the pH of the resultant reaction system is adjusted to about 7, and the reaction product is filtered out, washed with 500 parts of deionized water four times, and dried with a vacuum dryer to obtain toner particles (3).

The resulting toner particles (3) have a volume mean diameter of 5.8 μm, Mw of 30,000, and Mw/Mn of 4.37. Two parts of colloidal silica (trade name: R972, manufactured by Japan Aerosil) is externally added to and mixed with 100 parts of the resulting toner particles (3), using a Henschel mixer to obtain a toner for developing electrostatic latent images (3).

An infrared absorption spectrum of this toner is measured and, as a result, a maximum absorption peak appears at 675 $cm^{-1}$, and the absorption intensity P1 thereof is 1.30. In addition, a second greatest absorption peak appears at 1740 $cm^{-1}$, and the absorption intensity P2 thereof is 0.75. Thereby, P1/P2 is 1.73.

Preparation of Electrostatic Latent Image Developing Agent (3)

A two-component electrostatic latent image developer (3) having a toner concentration of 7% by mass is prepared in the same manner as in preparation of the two-component electrostatic latent image developer (1) except that the toner for developing electrostatic latent images (3) is used in place of the toner for developing electrostatic latent images (1) in preparation of the electrostatic latent image developing agent (1).

Preparation of Toner for Developing Electrostatic Images (4)

[Aggregating Step]

Preparation of Aggregated Particle

| | |
|---|---|
| Resin particle dispersion liquid (1) | 238.0 parts |
| Colorant dispersion liquid (5) | 17.5 parts |
| Releasing agent particle dispersion liquid (1) | 17.5 parts |
| Water glass (trade name: Snowtex OS, manufactured by Nissan Chemical Industries, Ltd.) | 35.0 parts |
| Deionized water | 620.8 parts |
| Aluminium sulfate (manufactured by Wako Pure Chemical Industries, Ltd.) | 1.3 parts |

The above-mentioned components are placed into a round-type stainless flask, and dispersed with a homogenizer (trade name: Ultratarax T50, manufactured by IKA). The pH of the content in the flask is adjusted to 3.5, and the content is heated to 48° C. in a heating oil bath while stirred. The content is maintained at 48° C. for 30 minutes, the state of the resultant reaction system is observed with a light microscope, and it is confirmed that aggregated particles having an average particle diameter of about 4.8 μm are formed. 59.5 parts of the resin particle dispersion liquid (1) is slowly added to the resultant aggregated particle dispersion liquid, and the resultant mixture is heated and stirred at 48° C. for 30 minutes while the pH thereof is maintained at 3.1. Thereafter, the state of the resultant reaction system is observed with the light microscope, and it is confirmed that aggregated particles having an average particle diameter of about 5.6 μm are formed.

[Coalescence Step]

The pH of this aggregated particle dispersion liquid is 3.2. A 0.5 mass % aqueous solution of sodium hydroxide (manufactured by Wako Pure Chemical Industries, Ltd.) is slowly added to the aggregated particle dispersion liquid, and the pH of the mixture is adjusted to 7.0. Thereafter, the mixture is heated to 96° C. and maintained at 96° C. for 5 hours while stirred. Then, the pH of the resultant reaction system is adjusted to about 7, and the reaction product is filtered out, washed with 500 parts of deionized water four times, and dried with a vacuum dryer to obtain toner particles (4).

The resulting toner particles (4) have a volume mean diameter of 5.8 μm, Mw of 29,500, and Mw/Mn of 4.33. Two parts of colloidal silica (trade name: R972, manufactured by Japan Aerosil) is externally added to and mixed with 100 parts of the resulting toner particles (4), using a Henschel mixer to obtain a toner for developing electrostatic latent images (4).

An infrared absorption spectrum of this toner is measured and, as a result, a maximum absorption peak appears at 675 $cm^{-1}$, and the absorption intensity P1 thereof is 1.27. In addition, a second greatest absorption peak appears at 1742 $cm^{-1}$, and the absorption intensity P2 thereof is 0.72. Thereby, P1/P2 is 1.76.

Preparation of Electrostatic Latent Image Developer (4)

A two-component electrostatic latent image developer (4) having a toner concentration of 7% by mass is prepared in the same manner as in preparation of the two-component electrostatic latent image developer (1) except that the toner for developing electrostatic latent images (4) is used in place of the toner for developing electrostatic latent images (1) in preparation of the electrostatic latent image developing agent (1).

Preparation of Toner for Developing Electrostatic Images (5)

[Aggregating Step]

Preparation of Aggregated Particle

| | |
|---|---|
| Resin particle dispersion liquid (2) | 238.0 parts |
| Colorant dispersion liquid (1) | 17.5 parts |
| Releasing agent particle dispersion liquid (1) | 17.5 parts |
| Water glass (trade name: Snowtex OS, manufactured by Nissan Chemical Industries, Ltd.) | 35.0 parts |
| Deionized water | 632.5 parts |
| Aluminium sulfate (manufactured by Wako Pure Chemical Industries, Ltd.) | 1.3 parts |

The above-mentioned components are placed into a round-type stainless flask, and dispersed with a homogenizer (trade name: Ultratarax T50, manufactured by IKA). The pH of the content in the flask is adjusted to 3.3, and the content is heated to 51° C. in a heating oil bath while stirred. The content is maintained at 51° C. for 30 minutes, the state of the resultant reaction system is observed with a light microscope, and it is confirmed that aggregated particles having an average particle diameter of about 6.2 μm are formed. 59.5 parts of the resin particle dispersion liquid (2) is slowly added to the resultant aggregated particle dispersion liquid, and the resultant mixture is heated and stirred at 51° C. for 25 minutes while the pH thereof is maintained at 3.3. Thereafter, the state of the resultant reaction system is observed with the light microscope, and it is confirmed that aggregated particles having an average particle diameter of about 6.5 μm are formed.

[Coalescence Step]

The pH of this aggregated particle dispersion liquid is 3.2. A 0.5 mass % aqueous solution of sodium hydroxide (manufactured by Wako Pure Chemical Industries, Ltd.) is slowly added to the aggregated particle dispersion liquid, and the pH of the mixture is adjusted to 6.8. Thereafter, the mixture is heated to 96° C. and maintained at 96° C. for 5 hours while stirred. Then, the pH of the resultant reaction system is adjusted to about 7, and the reaction product is filtered out, washed with 500 parts of deionized water four times, and dried with a vacuum dryer to obtain toner particles (5).

The resulting toner particles (5) have a volume mean diameter of 5.8 μm, Mw of 26,000, and Mw/Mn of 4.40. Two parts of colloidal silica (trade name: R972, manufactured by Japan Aerosil) is externally added to and mixed with 100 parts of the resulting toner particles (5), using a Henschel mixer to obtain a toner for developing electrostatic latent images (5).

An infrared absorption spectrum of this toner is measured and, as a result, a maximum absorption peak appears at 655 $cm^{-1}$, and the absorption intensity P1 thereof is 1.30. In addition, a second greatest absorption peak appears at 1742 $cm^{1}$, and the absorption intensity P2 thereof is 0.24. Thereby, P1/P2 is 5.42.

Preparation of Electrostatic Latent Image Developer (5)

A two-component electrostatic latent image developer (5) having a toner concentration of 7% by mass is prepared in the same manner as in preparation of the two-component electrostatic latent image developer (1) except that the toner for developing electrostatic latent images (5) is used in place of the toner for developing electrostatic latent images (1) in preparation of the electrostatic latent image developing agent (1).

Preparation of Toner for Developing Electrostatic Images (6)

[Aggregating Step]

Preparation of Aggregated Particle

| | |
|---|---|
| Resin particle dispersion liquid (3) | 238.0 parts |
| Colorant dispersion liquid (1) | 17.5 parts |
| Releasing agent particle dispersion liquid (1) | 17.5 parts |
| Water glass (trade name: Snowtex OS, manufactured by Nissan Chemical Industries, Ltd.) | 35.0 parts |
| Deionized water | 632.5 parts |
| Aluminium sulfate (manufactured by Wako Pure Chemical Industries, Ltd.) | 1.3 parts |

The above-mentioned components are placed into a round-type stainless flask, and dispersed with a homogenizer (trade name: Ultratarax T50, manufactured by IKA). The pH of the content in the flask is adjusted to 3.3, and the content is heated to 49° C. in a heating oil bath while stirred. The content is maintained at 49° C. for 30 minutes, the state of the resultant reaction system is observed with a light microscope, and it is confirmed that aggregated particles having an average particle diameter of about 5.6 μm are formed. 59.5 parts of the resin particle dispersion liquid (3) is slowly added to the resultant aggregated particle dispersion liquid, and the resultant mixture is heated and stirred at 49° C. for 30 minutes while the pH thereof is maintained at 3.3. Thereafter, the state of the resultant reaction system is observed with the light microscope, and it is confirmed that aggregated particles having an average particle diameter of about 6.0 μm are formed.

[Coalescence Step]

The pH of this aggregated particle dispersion liquid is 3.2. A 0.5 mass % aqueous solution of sodium hydroxide (manufactured by Wako Pure Chemical Industries, Ltd.) is slowly added to the aggregated particle dispersion liquid, and the pH of the mixture is adjusted to 6.5. Thereafter, the mixture is heated to 96° C. and maintained at 96° C. for 5 hours while stirred. Then, the pH of the resultant reaction system is adjusted to about 7, and the reaction product is filtered out, washed with 500 parts of deionized water four times, and dried with a vacuum dryer to obtain toner particles (6).

The resulting toner particles (6) have a volume mean diameter of 6.3 μm, Mw of 35,100, and Mw/Mn of 6.67. Two parts of colloidal silica (trade name: R972, manufactured by Japan Aerosil) is externally added to and mixed with 100 parts of the resulting toner particles (6), using a Henschel mixer to obtain a toner for developing electrostatic latent images (6).

An infrared absorption spectrum of this toner is measured and, as a result, a maximum absorption peak appears at 661 $cm^{-1}$, and the absorption intensity P1 thereof is 1.31. In addition, a second greatest absorption peak appears at 1750 $cm^{-1}$, and the absorption intensity P2 thereof is 0.33. Thereby, P1/P2 is 3.97.

Preparation of Electrostatic Latent Image Developer (6)

A two-component electrostatic latent image developer (6) having a toner concentration of 7% by mass is prepared in the same manner as in preparation of the two-component electrostatic latent image developer (1) except that the toner for developing electrostatic latent images (6) is used in place of the toner for developing electrostatic latent images (1) in preparation of the electrostatic latent image developing agent (1).

Preparation of Toner for Developing Electrostatic Latent Images (7)

[Aggregating Step]

Preparation of Aggregated Particle

| | |
|---|---|
| Resin particle dispersion liquid (4) | 238.0 parts |
| Colorant dispersion liquid (1) | 17.5 parts |
| Releasing agent particle dispersion liquid (1) | 17.5 parts |
| Water glass (trade name: Snowtex OS, manufactured by Nissan Chemical Industries, Ltd.) | 35.0 parts |
| Deionized water | 632.5 parts |
| Aluminium sulfate (manufactured by Wako Pure Chemical Industries, Ltd.) | 1.3 parts |

The above-mentioned components are placed into a round-type stainless flask, and dispersed with a homogenizer (trade name: Ultratarax T50, manufactured by IKA). The pH of the content in the flask is adjusted to 3.3, and the content is heated to 45° C. in a heating oil bath while stirred. The content is maintained at 45° C. for 30 minutes, the state of the resultant reaction system is observed with a light microscope, and it is confirmed that aggregated particles having an average particle diameter of about 4.6 μm are formed. 59.5 parts of the resin particle dispersion liquid (4) is slowly added to the resultant aggregated particle dispersion liquid, and the resultant mixture is heated and stirred at 45° C. for 30 minutes while the pH thereof is maintained at 3.3. Thereafter, the state of the resultant reaction system is observed with the light microscope, and it is confirmed that aggregated particles having an average particle diameter of about 4.9 μm are formed.

[Coalescence Step]

The pH of this aggregated particle dispersion liquid is 3.2. A 0.5 mass % aqueous solution of sodium hydroxide (manufactured by Wako Pure Chemical Industries, Ltd.) is slowly added to the aggregated particle dispersion liquid, and the pH of the mixture is adjusted to 6.5. Thereafter, the mixture is heated to 96° C. and maintained at 96° C. for 5 hours while stirred. Then, the pH of the resultant reaction system is adjusted to about 7, and the reaction product is filtered out, washed with 500 parts of deionized water four times, and dried with a vacuum dryer to obtain toner particles (7).

The resulting toner particles (7) have a volume mean diameter of 6.3 μm, Mw of 31,500, and Mw/Mn of 5.07. Two parts of colloidal silica (trade name: R972, manufactured by Japan Aerosil) is externally added to and mixed with 100 parts of the resulting toner particles (7), using a Henschel mixer to obtain a toner for developing electrostatic latent images (7).

An infrared absorption spectrum of this toner is measured and, as a result, a maximum absorption peak appears at 680 $cm^{-1}$, and the absorption intensity P1 thereof is 1.21. In addition, a second greatest absorption peak appears at 1742 $cm^{-1}$, and the absorption intensity P2 thereof is 0.30. Thereby, P1/P2 is 4.03.

Preparation of Electrostatic Latent Image Developer (7)

A two-component electrostatic latent image developer (7) having a toner concentration of 7% by mass is prepared in the same manner as in preparation of the two-component electrostatic latent image developer (1) except that the toner for developing electrostatic latent images (7) is used in place of the toner for developing electrostatic latent images (1) in preparation of the electrostatic latent image developing agent (1).

Preparation of Toner for Developing Electrostatic Images (8)

[Aggregating Step]

Preparation of Aggregated Particle

| | |
|---|---|
| Resin particle dispersion liquid (1) | 238.0 parts |
| Colorant dispersion liquid (1) | 17.5 parts |
| Releasing agent particle dispersion liquid (2) | 17.5 parts |
| Water glass (trade name: Snowtex OS, manufactured by Nissan Chemical Industries, Ltd.) | 35.0 parts |
| Deionized water | 632.5 parts |
| Magnesium chloride (manufactured by Wako Pure Chemical Industries, Ltd.) | 5.0 parts |

The above-mentioned components are placed into a round-type stainless flask, and dispersed with a homogenizer (trade name: Ultratarax T50, manufactured by IKA). The pH of the content in the flask is adjusted to 3.3, and the content is heated to 52° C. in a heating oil bath while stirred. The content is maintained at 52° C. for 50 minutes, the state of the resultant reaction system is observed with a light microscope, and it is confirmed that aggregated particles having an average particle diameter of about 6.2 μm are formed. 59.5 parts of the resin particle dispersion liquid (1) is slowly added to the resultant aggregated particle dispersion liquid, and the resultant mixture is heated and stirred at 52° C. for 20 minutes while the pH thereof is maintained at 3.3. Thereafter, the state of the resultant reaction system is observed with the light microscope, and it is confirmed that aggregated particles having an average particle diameter of about 6.5 μm are formed.

[Coalescence Step]

The pH of this aggregated particle dispersion liquid is 3.0. A 0.5 mass % aqueous solution of sodium hydroxide (manufactured by Wako Pure Chemical Industries, Ltd.) is slowly added to the aggregated particle dispersion liquid, and the pH of the mixture is adjusted to 7.4. Thereafter, the mixture is heated to 96° C. and maintained at 96° C. for 5 hours while stirred. Then, the pH of the resultant reaction system is adjusted to about 7, and the reaction product is filtered out, washed with 500 parts of deionized water four times, and dried with a vacuum dryer to obtain toner particles (8).

The resulting toner particles (8) have a volume mean diameter of 6.8 μm, Mw of 29,700, and Mw/Mn of 4.33. Two parts of colloidal silica (trade name: R972, manufactured by Japan Aerosil) is externally added to and mixed with 100 parts of the resulting toner particles (8), using a Henschel mixer to obtain a toner for developing electrostatic latent images (8).

An infrared absorption spectrum of this toner is measured and, as a result, a maximum absorption peak appears at 675 $cm^{-1}$, and the absorption intensity P1 thereof is 1.22. In addition, a second greatest absorption peak appears at 1740 $cm^{-1}$, and the absorption intensity P2 thereof is 0.69. Thereby, P1/P2 is 1.77.

Preparation of Electrostatic Latent Image Developer (8)

A two-component electrostatic latent image developer (8) having a toner concentration of 7% by mass is prepared in the same manner as in preparation of the two-component electrostatic latent image developer (1) except that the toner for developing electrostatic latent images (8) is used in place of the toner for developing electrostatic latent images (1) in preparation of the electrostatic latent image developing agent (1).

Preparation of Toner for Developing Electrostatic Images (9)

[Aggregating Step]

Preparation of Aggregated Particle

| | |
|---|---|
| Resin particle dispersion liquid (5) | 238.0 parts |
| Colorant dispersion liquid (1) | 17.5 parts |
| Releasing agent particle dispersion liquid (1) | 17.5 parts |
| Water glass (trade name: Snowtex OS, manufactured by Nissan Chemical Industries, Ltd.) | 35.0 parts |
| Deionized water | 632.5 parts |
| Magnesium chloride (manufactured by Wako Pure Chemical Industries, Ltd.) | 1.5 parts |

The above-mentioned components are placed into a round-type stainless flask, and dispersed with a homogenizer (trade name: Ultratarax T50, manufactured by IKA). The pH of the content in the flask is adjusted to 2.7, and the content is heated to 50° C. in a heating oil bath while stirred. The content is maintained at 50° C. for 30 minutes, the state of the resultant reaction system is observed with a light microscope, and it is confirmed that aggregated particles having an average particle diameter of about 5.2 μm are formed. 59.5 parts of the resin particle dispersion liquid (5) is slowly added to the resultant aggregated particle dispersion liquid, and the resultant mixture is heated and stirred at 50° C. for 30 minutes while the pH thereof is maintained at 2.7. Thereafter, the state of the resultant reaction system is observed with the light microscope, and it is confirmed that aggregated particles having an average particle diameter of about 5.5 μm are formed.

[Coalescence Step]

The pH of this aggregated particle dispersion liquid is 2.8. A 0.5 mass % aqueous solution of sodium hydroxide (manufactured by Wako Pure Chemical Industries, Ltd.) is slowly added to the aggregated particle dispersion liquid, and the pH of the mixture is adjusted to 7.0. Thereafter, the mixture is heated to 96° C. and maintained at 96° C. for 5 hours while stirred. Then, the pH of the resultant reaction system is adjusted to about 7, and the reaction product is filtered out, washed with 500 parts of deionized water four times, and dried with a vacuum dryer to obtain toner particles (9).

The resulting toner particles (9) have a volume mean diameter of 5.7 μm, Mw of 29,200, and Mw/Mn of 5.28. Two parts of colloidal silica (trade name: R972, manufactured by Japan Aerosil) is externally added to and mixed with 100 parts of the resulting toner particles (9), using a Henschel mixer to obtain a toner for developing electrostatic latent images (9).

An infrared absorption spectrum of this toner is measured and, as a result, a maximum absorption peak appears at 675 $cm^{-1}$, and the absorption intensity P1 thereof is 1.23. In addition, a second greatest absorption peak appears at 1743 $cm^{-1}$, and the absorption intensity P2 thereof is 0.69. Thereby, P1/P2 is 1.78.

Preparation of Electrostatic Latent Image Developer (9)

A two-component electrostatic latent image developer (9) having a toner concentration of 7% by mass is prepared in the same manner as in preparation of the two-component electrostatic latent image developer (1) except that the toner for developing electrostatic latent images (9) is used in place of the toner for developing electrostatic latent images (1) in preparation of the electrostatic latent image developing agent (1).

Preparation of Toner for Developing Electrostatic Images (10)

[Aggregating Step]

Preparation of Aggregated Particle

| | |
|---|---|
| Resin particle dispersion liquid (6) | 238.0 parts |
| Colorant dispersion liquid (1) | 17.5 parts |
| Releasing agent particle dispersion liquid (1) | 17.5 parts |
| Water glass (trade name: Snowtex OS, manufactured by Nissan Chemical Industries, Ltd.) | 35.0 parts |
| Deionized water | 632.5 parts |
| Aluminium sulfate (manufactured by Wako Pure Chemical Industries, Ltd.) | 1.3 parts |

The above-mentioned components are placed into a round-type stainless flask, and dispersed with a homogenizer (trade name: Ultratarax T50, manufactured by IKA). The pH of the content in the flask is adjusted to 3.4, and the content is heated to 45° C. in a heating oil bath while stirred. The content is maintained at 45° C. for 30 minutes, the state of the resultant reaction system is observed with a light microscope, and it is confirmed that aggregated particles having an average particle diameter of about 5.5 μm are formed. 59.5 parts of the resin particle dispersion liquid (6) is slowly added to the resultant aggregated particle dispersion liquid, and the resultant mixture is heated and stirred at 45° C. for 30 minutes while the pH thereof is maintained at 3.4. Thereafter, the state of the resultant reaction system is observed with the light microscope, and it is confirmed that aggregated particles having an average particle diameter of about 5.7 μm are formed.

[Coalescence Step]

The pH of this aggregated particle dispersion liquid is 3.3. A 0.5 mass % aqueous solution of sodium hydroxide (manufactured by Wako Pure Chemical Industries, Ltd.) is slowly added to the aggregated particle dispersion liquid, and the pH of the mixture is adjusted to 7.0. Thereafter, the mixture is heated to 93° C. and maintained at 93° C. for 4 hours while stirred. Then, the pH of the resultant reaction system is adjusted to about 7, and the reaction product is filtered out, washed with 500 parts of deionized water four times, and dried with a vacuum dryer to obtain toner particles (10).

The resulting toner particles (10) have a volume mean diameter of 5.7 μm, Mw of 17,000, and Mw/Mn of 8.38. Two parts of colloidal silica (trade name: R972, manufactured by Japan Aerosil) is externally added to and mixed with 100 parts of the resulting toner particles (10), using a Henschel mixer to obtain a toner for developing electrostatic latent images (10).

An infrared absorption spectrum of this toner is measured and, as a result, a maximum absorption peak appears at 675 $cm^{-1}$, and the absorption intensity P1 thereof is 1.41. In addition, a second greatest absorption peak appears at 1741 $cm^{-1}$, and the absorption intensity P2 thereof is 0.13. Thereby, P1/P2 is 10.85.

Preparation of Electrostatic Latent Image Developer (10)

A two-component electrostatic latent image developer (10) having a toner concentration of 7% by mass is prepared in the same manner as in preparation of the two-component electrostatic latent image developer (1) except that the toner for developing electrostatic latent images (10) is used in place of the toner for developing electrostatic latent images (1) in preparation of the electrostatic latent image developing agent (1).

Preparation of Toner for Developing Electrostatic Images (11)

[Aggregating Step]

Preparation of Aggregated Particle

| | |
|---|---|
| Resin particle dispersion liquid (7) | 238.0 parts |
| Colorant dispersion liquid (1) | 17.5 parts |
| Releasing agent particle dispersion liquid (1) | 17.5 parts |
| Water glass (trade name: Snowtex OS, manufactured by Nissan Chemical Industries, Ltd.) | 35.0 parts |
| Deionized water | 632.5 parts |
| Aluminium sulfate (manufactured by Wako Pure Chemical Industries, Ltd.) | 1.3 parts |

The above-mentioned components are placed into a round-type stainless flask, and dispersed with a homogenizer (trade name: Ultratarax T50, manufactured by IKA). The pH of the content in the flask is adjusted to 3.3, and the content is heated to 50° C. in a heating oil bath while stirred. The content is maintained at 50° C. for 30 minutes, the state of the resultant reaction system is observed with a light microscope, and it is confirmed that aggregated particles having an average particle diameter of about 5.2 μm are formed. 59.5 parts of the resin particle dispersion liquid (7) is slowly added to the resultant aggregated particle dispersion liquid, and the resultant mixture is heated and stirred at 50° C. for 30 minutes while the pH thereof is maintained at 3.3. Thereafter, the state of the resultant reaction system is observed with the light microscope, and it is confirmed that aggregated particles having an average particle diameter of about 5.5 μm are formed.

[Coalescence Step]

The pH of this aggregated particle dispersion liquid is 3.4. A 0.5 mass % aqueous solution of sodium hydroxide (manufactured by Wako Pure Chemical Industries, Ltd.) is slowly added to the aggregated particle dispersion liquid, and the pH of the mixture is adjusted to 7.0. Thereafter, the mixture is heated to 96° C. and maintained at 96° C. for 5 hours while stirred. Then, the pH of the resultant reaction system is adjusted to about 7, and the reaction product is filtered out, washed with 500 parts of deionized water four times, and dried with a vacuum dryer to obtain toner particles (11).

The resulting toner particles (11) have a volume mean diameter of 5.7 μm, Mw of 34,200, and Mw/Mn of 4.28. Two parts of colloidal silica (trade name: R972, manufactured by Japan Aerosil) is externally added to and mixed with 100 parts of the resulting toner particles (11), using a Henschel mixer to obtain a toner for developing electrostatic latent images (11).

An infrared absorption spectrum of this toner is measured and, as a result, a maximum absorption peak appears at 1741 $cm^{-1}$, and the absorption intensity P1 thereof is 0.77. In addition, a second greatest absorption peak appears at 2980 $cm^{-1}$, and the absorption intensity P2 thereof is 0.55. Thereby, P1/P2 is 1.40.

Preparation of Electrostatic Latent Image Developer (11)

A two-component electrostatic latent image developer (11) having a toner concentration of 7% by mass is prepared in the same manner as in preparation of the two-component electrostatic latent image developer (1) except that the toner for developing electrostatic latent images (11) is used in place of the toner for developing electrostatic latent images (1) in preparation of the electrostatic latent image developing agent (1).

Preparation of Toner for Developing Electrostatic Latent Images (12)

30 parts of a phthalocyanine pigment (trade name: PV FAST BLUE, manufactured by Dainichiseika Color & Chemicals Mfg. Co., Ltd.) and 30 parts of a polyethylene wax (trade name: Polywax 725, manufactured by Toyo-Petrolite) are added to 40 parts of a styrene-acrylic resin (manufactured by Soken Chemical & Engineering Co. Ltd., Mw: 32,000), and the resultant is molten and kneaded with a pressure type kneader to prepare a resin mixture 1.

Preparation of Suspension Particle

| | |
|---|---|
| Styrene | 189.5 parts |
| n-Butyl acrylate | 41.6 parts |
| tert- Laurylmercaptan | 16.5 parts |
| 2,2-Azobis-2-methylvaleronitrile (all manufactured by Wako Pure Chemical Industries, Ltd.) | 2.4 parts |
| Resin mixture 1 | 50 parts |

After the above components are stirred and molten, the resultant mixture is added to an aqueous medium in which 30 parts of calcium carbonate has been dispersed in 600 parts of deionized water, and dispersed with a homogenizer (trade name: Ultratarax T50, manufactured by IKA), and it is confirmed that oil droplets having an average particle diameter of 7.3 μm exists in the resultant dispersion. This dispersion is heated to 80° C. and maintained at 80° C. for 5 hours while nitrogen is introduced to the dispersion, to obtain suspension polymerization particles. After cooling, 1N of hydrochloric acid (manufactured by Wako Pure Chemical Industries, Ltd.) is added dropwise to the resultant reaction system to adjust the pH of the system to 2.2, and the resultant is allowed to stand for 1 hour. Thereafter, the pH of the system is adjusted to about 7, the reaction product is filtered out, washed with 500 parts of deionized water four times, and dried with a vacuum dryer to obtain toner particles (12).

The resulting toner particles (12) have a volume average particle diameter of 7.5 μm, Mw of 35,100 and Mw/Mn of 7.02. Two parts of colloidal silica (trade name: R972, manufactured by Japan Aerosil) is externally added to and mixed with 100 parts of the toner particles (12), using a Henschel mixer to obtain a toner for developing electrostatic latent images (12).

An infrared absorption spectrum of this toner is measured and, as a result, it is found that a maximum absorption peak appears at 675 $cm^{-1}$, and the absorption intensity P1 thereof is 1.30. In addition, it is found that a second greatest absorption peak appears at 1743 $cm^{-1}$, and the absorption intensity P2 thereof is 0.42. Thereby, P1/P2 is 3.10.

Preparation of Electrostatic Latent Image Developer (12)

A two-component electrostatic latent image developer (12) having a toner concentration of 7% by mass is prepared in the same manner as in preparation of the two-component electrostatic latent image developer (1) except that the toner for developing electrostatic latent images (12) is used in place of the toner for developing electrostatic latent images (1) in preparation of the electrostatic latent image developing agent (1).

Preparation of Electrostatic Latent Image Developing Agent (13)

100 parts of ferrite particles (manufactured by Powdertech Co., Ltd., volume mean diameter: 50 μm), 8.1 parts of a silicone resin (SR2411 manufactured by Dow Corning Toray Silicone Co. Ltd.) and 80 parts of toluene are placed in a pressure type kneader, stirred, and mixed at a normal temperature for 15 minutes, and heated to 100° C. while stirred under reduced pressure, to remove toluene. Thereafter, the resultant is further heated to 160° C. and maintained at 160° C. for 1 hour. Thereafter, the resultant reaction system is cooled, and obtained particles are classified with a sieve having a pore size of 105 μm to prepare a ferrite carrier (resin-covered carrier).

This ferrite carrier and the toner for developing electrostatic images (1) are mixed with each other to prepare a two-component electrostatic charge image developer (13) having a toner concentration of 7% by mass.

Preparation of Electrostatic Latent Image Developer (14)

A two-component electrostatic latent image developer (14) having a toner concentration of 7% by mass is prepared in the same manner as in preparation of the two-component electrostatic latent image developer (13) except that the toner for developing electrostatic latent images (2) is used in place of the toner for developing electrostatic latent images (1) in preparation of the electrostatic latent image developing agent (13).

Preparation of Electrostatic Latent Image Developer (15)

A two-component electrostatic latent image developer (15) having a toner concentration of 7% by mass is prepared in the same manner as in preparation of the two-component electrostatic latent image developer (13) except that the toner for developing electrostatic latent images (3) is used in place of the toner for developing electrostatic latent images (1) in preparation of the electrostatic latent image developing agent (13).

Preparation of Electrostatic Latent Image Developer (16)

A two-component electrostatic latent image developer (16) having a toner concentration of 7% by mass is prepared in the same manner as in preparation of the two-component electrostatic latent image developer (13) except that the toner for developing electrostatic latent images (4) is used in place of the toner for developing electrostatic latent images (1) in preparation of the electrostatic latent image developing agent (13).

EXAMPLE 1

Using a copying machine (modified machine of Vivace400 manufactured by Fuji Xerox Co., Ltd.) and the electrostatic latent image developer (1) as a developer, a toner charge amount of the electrostatic charge image developer (1) is adjusted so as to form a solid portion having a toner amount of 4.0 $g/m^2$, and then an unfixed toner image is obtained. After the image formation is repeated 100 times, fixation evaluations of the first and $100^{th}$ unfixed images are conducted with an external fixing bench.

The external fixing bench is prepared as follows.

First, a heating roll is prepared by adhering a Viton rubber having a thickness of 1 mm to the periphery of a metal roll having an external diameter of 40 mm, and adhering a sheet made of a polyfluoroethylene-polyvinylidene fluoride copolymer to the rubber. A pressure roll is prepared by adhering a Viton rubber which is softer than the aforementioned Viton rubber to the periphery of a metal roll having an external diameter of 40 mm. Then, the width of an area of the pressure roll which area is brought into contact with the heating roll is adjusted to 6 mm, and a velocity of paper passing between the pressure roll and the heating roll is adjusted to 180 mm/sec. In addition, a sensor which detects the surface temperature of the heating roll is provided in the vicinity of the heating roll, and an exothermic lamp having a heating power which is turned off when the surface temperature of the heating roll is equal to or greater than a set temperature, is disposed in the interior of the heating roll.

When such an external fixing bench is used, and when the surface temperature of the heating roll reaches a set temperature (160° C., 180° C., 200° C.), a paper sheet having thereon an unfixed toner image is made to pass the external fixing bench and, thus, a fixing test is conducted.

The fixing test is conducted at a set temperature of 160° C., 180° C. and 200° C., respectively, and glossinesses of fixed images at each temperature are measured. Further, whether uneven glossiness of the image fixed at 180° C. is present is checked with naked eyes. J paper manufactured by Fuji Xerox Co. Ltd. is employed as the paper sheet and GM-26D (manufactured by Murakami Color Material Technology Institute) is used as a gross meter.

P1, P2 and P1/P2 of the toner used in this Example are shown in Table 1, and the results of glossiness and glossiness evaluation with naked eyed are shown in Table 2.

EXAMPLE 2

The same fixing test as in Example 1 is conducted except that the electrostatic latent image developer (2) is used in place of the electrostatic latent image developer (1).

The results are shown in Table 1 and Table 2.

EXAMPLE 3

The same fixing test as in Example 1 is conducted except that the electrostatic latent image developer (3) is used in place of the electrostatic latent image developer (1).

The results are shown in Table 1 and Table 2.

EXAMPLE 4

The same fixing test as in Example 1 is conducted except that the electrostatic latent image developer (4) is used in place of the electrostatic latent image developer (1).

The results are shown in Table 1 and Table 2.

EXAMPLE 5

The same fixing test as in Example 1 is conducted except that the electrostatic latent image developer (5) is used in place of the electrostatic latent image developer (1).

The results are shown in Table 1 and Table 2.

EXAMPLE 6

The same fixing test as in Example 1 is conducted except that the electrostatic latent image developer (6) is used in place of the electrostatic latent image developer (1).

The results are shown in Table 1 and Table 2.

EXAMPLE 7

The same fixing test as in Example 1 is conducted except that the electrostatic latent image developer (7) is used in place of the electrostatic latent image developer (1).

The results are shown in Table 1 and Table 2.

EXAMPLE 8

The same fixing test as in Example 1 is conducted except that the electrostatic latent image developer (8) is used in place of the electrostatic latent image developer (1).

The results are shown in Table 1 and Table 2.

EXAMPLE 9

The same fixing test as in Example 1 is conducted except that the electrostatic latent image developer (9) is used in place of the electrostatic latent image developer (1).

The results are shown in Table 1 and Table 2.

EXAMPLE 10

The same fixing test as in Example 1 is conducted except that the electrostatic latent image developer (13) is used in place of the electrostatic latent image developer (1).

The results are shown in Table 1 and Table 2.

EXAMPLE 11

The same fixing test as in Example 1 is conducted except that the electrostatic latent image developer (14) is used in place of the electrostatic latent image developer (1).

The results are shown in Table 1 and Table 2.

EXAMPLE 12

The same fixing test as in Example 1 is conducted except that the electrostatic latent image developer (15) is used in place of the electrostatic latent image developer (1).

The results are shown in Table 1 and Table 2.

EXAMPLE 13

The same fixing test as in Example 1 is conducted except that the electrostatic latent image developer (16) is used in place of the electrostatic latent image developer (1).

The results are shown in Table 1 and Table 2.

EXAMPLE 14

The same fixing test as in Example 1 is conducted except that the electrostatic latent image developer (12) is used in place of the electrostatic latent image developer (1).

The results are shown in Table 1 and Table 2.

COMPARATIVE EXAMPLE 1

The same fixing test as in Example 1 is conducted except that the electrostatic latent image developer (10) is used in place of the electrostatic latent image developer (1).

The results are shown in Table 1 and Table 2.

COMPARATIVE EXAMPLE 2

The same fixing test as in Example 1 is conducted except that the electrostatic latent image developer (11) is used in place of the electrostatic latent image developer (1).

The results are shown in Table 1 and Table 2.

EXAMPLE 15

The same fixing test as in Example 1 is conducted except that a belt having a polyimide film as the surface layer thereof is used in place of the pressure roll, that a pressure pad is provided so that it faces the heating roll via the belt, that the width of an area of the heating roll which area is brought into contact with the polyimide film as the surface of the belt is adjusted to 8 mm, and that a velocity of a paper sheet passing between the belt and the heating roll is adjusted to be 200 mm/sec.

The results are shown in Table 1 and Table 2.

EXAMPLE 16

The same fixing test as in Example 15 is conducted, except that the electrostatic latent image developer (2) is used in place of the electrostatic latent image developer (1).

The results are shown in Table 1 and Table 2.

EXAMPLE 17

The same fixing test as in Example 15 is conducted, except that the electrostatic latent image developer (3) is used in place of the electrostatic latent image developer (1).

The results are shown in Table 1 and Table 2.

EXAMPLE 18

The same fixing test as in Example 15 is conducted, except that the electrostatic latent image developer (4) is used in place of the electrostatic latent image developer (1).

The results are shown in Table 1 and Table 2.

EXAMPLE 19

The same fixing test as in Example 15 is conducted, except that the electrostatic latent image developer (5) is used in place of the electrostatic latent image developer (1).

The results are shown in Table 1 and Table 2.

EXAMPLE 20

The same fixing test as in Example 15 is conducted, except that the electrostatic latent image developer (6) is used in place of the electrostatic latent image developer (1).

The results are shown in Table 1 and Table 2.

EXAMPLE 21

The same fixing test as in Example 15 is conducted, except that the electrostatic latent image developer (7) is used in place of the electrostatic latent image developer (1).

The results are shown in Table 1 and Table 2.

EXAMPLE 22

The same fixing test as in Example 15 is conducted, except that the electrostatic latent image developer (8) is used in place of the electrostatic latent image developer (1).

The results are shown in Table 1 and Table 2.

EXAMPLE 23

The same fixing test as in Example 15 is conducted, except that the electrostatic latent image developer (9) is used in place of the electrostatic latent image developer (1).

The results are shown in Table 1 and Table 2.

EXAMPLE 24

The same fixing test as in Example 15 is conducted, except that the electrostatic latent image developer (13) is used in place of the electrostatic latent image developer (1).

The results are shown in Table 1 and Table 2.

EXAMPLE 25

The same fixing test as in Example 15 is conducted, except that the electrostatic latent image developer (14) is used in place of the electrostatic latent image developer (1).

The results are shown in Table 1 and Table 2.

EXAMPLE 26

The same fixing test as in Example 15 is conducted, except that the electrostatic latent image developer (15) is used in place of the electrostatic latent image developer (1).

The results are shown in Table 1 and Table 2.

EXAMPLE 27

The same fixing test as in Example 15 is conducted, except that the electrostatic latent image developer (16) is used in place of the electrostatic latent image developer (1).

The results are shown in Table 1 and Table 2.

EXAMPLE 28

The same fixing test as in Example 15 is conducted, except that the electrostatic latent image developer (12) is used in place of the electrostatic latent image developer (1).

The results are shown in Table 1 and Table 2.

COMPARATIVE EXAMPLE 3

The same fixing test as in Example 15 is conducted, except that the electrostatic latent image developer (10) is used in place of the electrostatic latent image developer (1).

The results are shown in Table 1 and Table 2.

COMPARATIVE EXAMPLE 4

The same fixing test as in Example 15 is conducted, except that the electrostatic latent image developer (11) is used in place of the electrostatic latent image developer (1).

The results are shown in Table 1 and Table 2.

TABLE 1

| | | Maximum Absorption peak | | Second Absorption peak | | |
|---|---|---|---|---|---|---|
| | Toner No. | Wave Number ($cm^{-1}$) | P1 | Wave Number ($cm^{-1}$) | P2 | P1/P2 |
| Example 1 | (1) | 675 | 1.22 | 1740 | 0.71 | 1.72 |
| Example 2 | (2) | 674 | 1.25 | 1741 | 0.7 | 1.79 |
| Example 3 | (3) | 675 | 1.3 | 1740 | 0.75 | 1.73 |
| Example 4 | (4) | 675 | 1.27 | 1742 | 0.72 | 1.76 |
| Example 5 | (5) | 655 | 1.3 | 1742 | 0.24 | 5.42 |
| Example 6 | (6) | 661 | 1.31 | 1750 | 0.33 | 3.97 |
| Example 7 | (7) | 680 | 1.21 | 1742 | 0.3 | 4.03 |
| Example 8 | (8) | 675 | 1.22 | 1740 | 0.69 | 1.77 |
| Example 9 | (9) | 675 | 1.23 | 1743 | 0.68 | 1.81 |
| Example 10 | (1) | 675 | 1.22 | 1740 | 0.71 | 1.72 |
| Example 11 | (2) | 674 | 1.25 | 1741 | 0.7 | 1.79 |
| Example 12 | (3) | 675 | 1.3 | 1740 | 0.75 | 1.73 |
| Example 13 | (4) | 675 | 1.27 | 1742 | 0.72 | 1.76 |
| Example 14 | (12) | 675 | 1.3 | 1743 | 0.42 | 3.1 |
| Example 15 | (1) | 675 | 1.22 | 1740 | 0.71 | 1.72 |
| Example 16 | (2) | 674 | 1.25 | 1741 | 0.7 | 1.79 |
| Example 17 | (3) | 675 | 1.3 | 1740 | 0.75 | 1.73 |
| Example 18 | (4) | 675 | 1.27 | 1742 | 0.72 | 1.76 |
| Example 19 | (5) | 655 | 1.3 | 1742 | 0.24 | 5.42 |
| Example 20 | (6) | 661 | 1.31 | 1750 | 0.33 | 3.97 |
| Example 21 | (7) | 680 | 1.21 | 1742 | 0.3 | 4.03 |
| Example 22 | (8) | 675 | 1.22 | 1740 | 0.69 | 1.77 |
| Example 23 | (9) | 675 | 1.23 | 1743 | 0.68 | 1.81 |
| Example 24 | (1) | 675 | 1.22 | 1740 | 0.71 | 1.72 |
| Example 25 | (2) | 674 | 1.25 | 1741 | 0.7 | 1.79 |
| Example 26 | (3) | 675 | 1.3 | 1740 | 0.75 | 1.73 |
| Example 27 | (4) | 675 | 1.27 | 1742 | 0.72 | 1.76 |
| Example 28 | (12) | 675 | 1.3 | 1743 | 0.42 | 3.1 |
| Comparative Example 1 | (10) | 675 | 1.41 | 1741 | 0.13 | 10.8 |
| Comparative Example 2 | (11) | 1741 | 0.77 | 2980 | 0.55 | 1.4 |
| Comparative Example 3 | (10) | 675 | 1.41 | 1741 | 0.13 | 10.8 |
| Comparative Example 4 | (11) | 1741 | 0.77 | 2980 | 0.55 | 1.4 |

TABLE 2

| | G (160) (%) | | G (180) (%) | | G (200) (%) | | G (180) · G (160) | | G (200) · G (180) | | {G (200) · G (180)}/{G (180) · G (160)} | | Glossiness with naked eyes | |
|---|---|---|---|---|---|---|---|---|---|---|---|---|---|---|
| | Initial | 100th image | Initial | 100th image | Initial | 100th image | Initial | 100th image | Initial | 100th image | Initial | 100th image | Initial | 100th image |
| Example 1 | 26 | 22 | 44 | 42 | 51 | 48 | 18 | 20 | 7 | 6 | 0.39 | 0.30 | Good | Good |
| Example 2 | 23 | 20 | 43 | 40 | 49 | 47 | 20 | 20 | 6 | 7 | 0.30 | 0.35 | Good | Good |
| Example 3 | 25 | 24 | 46 | 45 | 52 | 50 | 21 | 21 | 6 | 5 | 0.28 | 0.24 | Good | Good |

TABLE 2-continued

| | G (160) (%) | | G (180) (%) | | G (200) (%) | | G (180) · G (160) | | G (200) · G (180) | | {G (200) · G (180)}/{G (180) · G (160)} | | Glossiness with naked eyes | |
|---|---|---|---|---|---|---|---|---|---|---|---|---|---|---|
| | Initial | 100th image | Initial | 100th image | Initial | 100th image | Initial | 100th image | Initial | 100th image | Initial | 100th image | Initial | 100th image |
| Example 4 | 22 | 20 | 40 | 37 | 45 | 43 | 18 | 17 | 5 | 6 | 0.28 | 0.35 | Good | Good |
| Example 5 | 30 | 29 | 50 | 48 | 52 | 49 | 20 | 19 | 2 | 1 | 0.10 | 0.05 | Good | Good |
| Example 6 | 27 | 25 | 47 | 45 | 48 | 47 | 20 | 20 | 1 | 2 | 0.05 | 0.10 | Good | Good |
| Example 7 | 24 | 22 | 34 | 33 | 41 | 38 | 10 | 11 | 7 | 5 | 0.70 | 0.45 | Good | Good |
| Example 8 | 26 | 25 | 30 | 28 | 33 | 30 | 4 | 3 | 3 | 2 | 0.75 | 0.67 | Good | Good |
| Example 9 | 29 | 28 | 40 | 39 | 44 | 44 | 11 | 11 | 4 | 5 | 0.36 | 0.45 | Good | Good |
| Example 10 | 27 | 27 | 44 | 42 | 50 | 49 | 17 | 15 | 6 | 7 | 0.35 | 0.47 | Good | Good |
| Example 11 | 24 | 23 | 45 | 42 | 49 | 47 | 21 | 19 | 4 | 5 | 0.19 | 0.26 | Good | Good |
| Example 12 | 25 | 24 | 48 | 45 | 53 | 50 | 23 | 21 | 5 | 5 | 0.22 | 0.24 | Good | Good |
| Example 13 | 25 | 24 | 42 | 40 | 45 | 44 | 17 | 16 | 3 | 4 | 0.18 | 0.25 | Good | Good |
| Example 14 | 21 | 20 | 30 | 29 | 32 | 31 | 9 | 9 | 2 | 2 | 0.22 | 0.22 | Good | Good |
| Example 15 | 24 | 22 | 43 | 42 | 50 | 48 | 19 | 20 | 7 | 6 | 0.37 | 0.30 | Good | Good |
| Example 16 | 21 | 19 | 40 | 38 | 48 | 46 | 19 | 19 | 8 | 8 | 0.42 | 0.42 | Good | Good |
| Example 17 | 22 | 20 | 45 | 43 | 50 | 47 | 23 | 23 | 5 | 4 | 0.22 | 0.17 | Good | Good |
| Example 18 | 21 | 18 | 38 | 37 | 42 | 40 | 17 | 19 | 4 | 3 | 0.24 | 0.16 | Good | Good |
| Example 19 | 27 | 25 | 46 | 45 | 50 | 49 | 19 | 20 | 4 | 4 | 0.21 | 0.20 | Good | Good |
| Example 20 | 25 | 22 | 46 | 45 | 46 | 46 | 21 | 23 | 0 | 1 | 0.00 | 0.04 | Good | Good |
| Example 21 | 22 | 22 | 33 | 32 | 39 | 39 | 22 | 10 | 6 | 7 | 0.27 | 0.70 | Good | Good |
| Example 22 | 24 | 23 | 29 | 27 | 31 | 30 | 5 | 4 | 3 | 3 | 0.60 | 0.75 | Good | Good |
| Example 23 | 26 | 25 | 38 | 36 | 43 | 42 | 12 | 11 | 5 | 6 | 0.42 | 0.55 | Good | Good |
| Example 24 | 25 | 23 | 41 | 40 | 48 | 47 | 16 | 17 | 7 | 7 | 0.44 | 0.41 | Good | Good |
| Example 25 | 22 | 20 | 44 | 44 | 48 | 46 | 22 | 24 | 4 | 2 | 0.18 | 0.08 | Good | Good |
| Example 26 | 23 | 21 | 47 | 46 | 52 | 50 | 24 | 25 | 5 | 4 | 0.21 | 0.16 | Good | Good |
| Example 27 | 22 | 21 | 41 | 40 | 44 | 43 | 19 | 19 | 3 | 3 | 0.16 | 0.16 | Good | Good |
| Example 28 | 20 | 18 | 28 | 26 | 31 | 31 | 8 | 8 | 3 | 5 | 0.38 | 0.63 | Good | Good |
| Comparative Example 1 | 41 | 38 | 47 | 46 | 39 | 39 | 6 | 8 | −8 | −7 | −0.75 | −0.88 | * | * |
| Comparative Example 2 | 13 | 10 | 17 | 16 | 35 | 34 | 4 | 6 | 18 | 18 | 4.50 | 3.00 | * | * |
| Comparative Example 3 | 39 | 36 | 45 | 43 | 40 | 39 | 6 | 7 | −5 | −4 | −0.83 | −0.57 | * | * |
| Comparative Example 4 | 11 | 9 | 15 | 13 | 32 | 30 | 4 | 4 | 17 | 17 | 4.30 | 4.25 | * | * |

* uneven glossiness is observed

From the result shown in Table 1, the following is apparent. That is, the surfaces of fixed images formed in Examples 1 to 28 have a smaller difference in glossiness relative to a fixed temperature than the surfaces of fixed images formed in Comparative Examples 1 to 4. Therefore, since toners used in Examples 1 to 28 have stability of the glossiness, those toners can provide a high quality image having high glossiness and no uneven glossiness.

What is claimed is:

1. A toner, comprising a binder resin and a colorant, and having a plurality of absorption peaks in a wave number range of 400 to 4,000 $cm^{-1}$ in an infrared absorption spectrum, wherein among the plurality of absorption peaks, a maximum absorption peak appears at wave number ranging from 500 to 800 $cm^{-1}$ and, given that the intensity of the maximum absorption peak is P1 and that the intensity of a second greatest absorption peak is P2, P1 and P2 satisfy the following equation (1), $$1.6 \leqq P1/P2 \leqq 6.0 \qquad \text{Equation (1)}$$

wherein the binder resin is a styrene-acrylic resin having a weight average molecular weight Mw of 20,000 to 40,000, and a number average molecular weight Mn of 3,000 to 8,000, and wherein the binder resin is prepared by using a chain transfer agent, and the chain transfer agent is selected from an n-alkylmercaptan, a branched alkylmercaptan and an aromatic ring-containing mercaptan which have at least 4 carbon atoms.

2. The toner of claim 1, wherein the toner is prepared by a wet process.

3. The toner of claim 2, which is prepared by a method of mixing a resin particle dispersion liquid in which resin particles having an average particle diameter of 1 micron or smaller are dispersed, and a colorant dispersion liquid in which a colorant is dispersed, forming toner size aggregates including the resin particles and the colorant, and heating and coalescing the toner size aggregates.

4. The toner of claim 1, wherein, when glossiness of a fixed image at surface temperature of a fixing member of t° C. is G(t), and when glossiness of a fixed image at a surface temperature of t−20° C. is G(t−20) and when glossiness of a fixed image at the surface temperature of t+20° C. is G(t+20), G(t), G(t−20) and G(t+20) satisfy the following equation (2)

$$0 \leqq [G(t+20)-G(t)]/[G(t)-G(t-20)] \leqq 0.8 \qquad \text{Equation (2).}$$

5. The toner of claim 1, wherein the P1/P2 is 1.6 to 4.0.

6. The toner of claim 1, wherein the binder resin is prepared at a mass ratio A/B, of a mass A of a polymerization initiator and a mass B of a chain transfer agent, of 0.6/4.0 to 0.04/10.0.

7. The toner of claim 1, wherein the toner further contains a releasing agent at 0.5 to 50% by mass.

8. The toner of claim 1, wherein the binder resin contains a cross-linking agent.

9. The toner of claim 8, wherein the amount of the cross-linking agent is 1% by mass or less of a total amount of the binder resin.

10. A two-component developer, comprising the toner of claim 1 and a carrier.

11. The two-component developer of claim 10, wherein an absolute value of a charged amount of the toner is 10 to 40 μC/g.

12. The two-component developer of claim 10, wherein the carrier has a resin coating layer.

13. An image forming method, comprising the steps of:

forming an electrostatic latent image on a surface of an electrostatic latent image holding member;

developing the electrostatic latent image with a developer containing a toner on a surface of a developer holding member to form a toner image;

transferring the toner image onto a surface of a recording material; and fixing the toner image onto the surface of the recording medium, wherein the toner is the toner of claim 1.

14. The image forming method of claim 13, wherein a fixing member and the toner are brought into contact with each other in the fixing step, and a surface of the fixing member contains fluororesin.

15. The image forming method of claim 13, wherein the recording medium is a sheet of paper having a basis weight of 30 to 150 $g/m^2$.

16. The image forming method of claim 13, wherein a contact time of the fixing member and the toner is 30 to 100 ms.

17. An image forming apparatus comprising an electrostatic latent image holding member, exposing means for exposing the electrostatic latent image holding member to form an electrostatic latent image, developing means having the toner of claim 1 for adhering to the electrostatic latent image to form a toner image, transferring mean for transferring the toner image onto a surface of a recording medium, and fixing means for fixing the toner image onto the surface of the recording medium.

* * * * *